US011767633B2

(12) United States Patent
Bellinger et al.

(10) Patent No.: US 11,767,633 B2
(45) Date of Patent: Sep. 26, 2023

(54) DRYING APPLIANCE HAVING AN ACCESSORY PORT FOR PROVIDING EXTERNAL AIRFLOW FOR POWERED ACCESSORIES

(71) Applicant: WHIRLPOOL CORPORATION, Benton Harbor, MI (US)

(72) Inventors: Ryan R. Bellinger, St. Joseph, MI (US); Seth E. Bixby, Stevensville, MI (US); Timothy E. Heater, Hartford, MI (US); Jacob C. Ickes, Baroda, MI (US); Sayer J. Murphy, St. Joseph, MI (US); Giuseppe Netti, Varese (IT); Michael T. Roche, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 574 days.

(21) Appl. No.: 16/877,522

(22) Filed: May 19, 2020

(65) Prior Publication Data

US 2021/0002811 A1 Jan. 7, 2021

Related U.S. Application Data

(60) Provisional application No. 62/869,230, filed on Jul. 1, 2019.

(51) Int. Cl.

| | |
|---|---|
| ***D06F 58/20*** | (2006.01) |
| ***D06F 58/22*** | (2006.01) |
| *D06F 103/12* | (2020.01) |
| *D06F 103/08* | (2020.01) |

(52) U.S. Cl.
CPC ..... *D06F 58/206* (2013.01); *D06F 58/203* (2013.01); *D06F 58/22* (2013.01); *D06F 2103/08* (2020.02); *D06F 2103/12* (2020.02)

(58) Field of Classification Search
CPC ..... D06F 58/206; D06F 58/203; D06F 58/22; D06F 2103/08; D06F 2103/12; D06F 73/02; D06F 58/30; D06F 58/32; D06F 58/34; D06F 58/36; D06F 58/38; D06F 58/40; D06F 58/42; D06F 58/44; D06F 58/45;
(Continued)

(56) References Cited

U.S. PATENT DOCUMENTS 3,197,886 A * 8/1965 Brame ..... D06F 58/00 34/607
3,417,481 A 12/1968 Rumsey, Jr.
(Continued)

FOREIGN PATENT DOCUMENTS

EP 1975306 10/2008
EP 2194184 6/2010
WO WO-2015072634 A1 * 5/2015 ..... A47L 23/205

*Primary Examiner* — Edelmira Bosques
*Assistant Examiner* — Bao D Nguyen
(74) *Attorney, Agent, or Firm* — Price Heneveld LLP

(57) ABSTRACT

A laundry appliance includes a processing chamber positioned within a cabinet. A blower delivers process air through an airflow path and through the processing chamber. An accessory port is positioned on an exterior surface of the cabinet and coupled with the airflow path. The accessory port selectively redirects the process air through an accessory airflow path to define accessory process air. An accessory tool that selectively engages the accessory port to define the accessory airflow path.

20 Claims, 28 Drawing Sheets

(58) Field of Classification Search
CPC ..... D06F 58/46; D06F 58/50; A47L 23/20; A47L 23/205
See application file for complete search history.

(56) References Cited

U.S. PATENT DOCUMENTS

| | | | | | |
|---|---|---|---|---|---|
| 3,750,304 | A | * | 8/1973 | Ghadiali | D06F 58/20 34/131 |
| 3,999,304 | A | * | 12/1976 | Doty | D06F 58/22 34/90 |
| 5,107,603 | A | | 12/1992 | Durazzani | |
| 8,695,228 | B2 | | 4/2014 | Lee et al. | |
| 8,819,956 | B2 | | 9/2014 | Kim et al. | |
| 8,844,160 | B2 | | 9/2014 | Beihoff et al. | |
| 9,416,484 | B2 | | 8/2016 | Campagnolo et al. | |
| 10,100,459 | B2 | | 10/2018 | Groppel | |
| 2008/0028570 | A1 | | 2/2008 | Diaz De Rivera | |
| 2018/0187367 | A1 | | 7/2018 | Bae | |

* cited by examiner

DRYING APPLIANCE HAVING AN ACCESSORY PORT FOR PROVIDING EXTERNAL AIRFLOW FOR POWERED ACCESSORIES

CROSS-REFERENCE TO RELATED APPLICATION

This application claims priority to and the benefit under 35 U.S.C. § 119(e) of U.S. Provisional Patent Application No. 62/869,230, filed on Jul. 1, 2019, entitled DRYING APPLIANCE HAVING AN ACCESSORY PORT FOR PROVIDING EXTERNAL AIRFLOW FOR POWERED ACCESSORIES, the entire disclosure of which is hereby incorporated herein by reference.

FIELD OF THE DEVICE

The device is in the field of laundry appliances, and more specifically, an accessory port for a laundry appliance that places an external air-driven tool in communication with an airflow path of the appliance.

BRIEF SUMMARY OF THE DEVICE

According to one aspect of the present disclosure, a laundry appliance includes a processing chamber positioned within a cabinet. A blower delivers process air through an airflow path and through the processing chamber. An accessory port is positioned on an exterior surface of the cabinet and coupled with the airflow path. The accessory port selectively redirects the process air through an accessory airflow path to define accessory process air. An accessory tool that selectively engages the accessory port to define the accessory airflow path.

According to another aspect of the present disclosure, a laundry appliance includes a processing chamber positioned within a cabinet. A blower delivers process air through a recirculating airflow path that includes the processing chamber. An accessory port is positioned on an exterior surface of the cabinet and coupled with the recirculating airflow path. The accessory port selectively redirects the process air through an accessory airflow path to define accessory process air. An accessory tool selectively engages the accessory port to define the accessory airflow path.

According to yet another aspect of the present disclosure, a laundry appliance includes a processing chamber positioned within a cabinet. A blower delivers process air through an airflow path and to an exhaust port. The airflow path includes the processing chamber. An accessory port is positioned on an exterior surface of the cabinet and coupled with the airflow path. The accessory port selectively redirects the process air through an accessory airflow path to define accessory process air. An accessory tool selectively engages the accessory port to define the accessory airflow path.

These and other features, advantages, and objects of the present disclosure will be further understood and appreciated by those skilled in the art by reference to the following specification, claims, and appended drawings.

Figure 1:
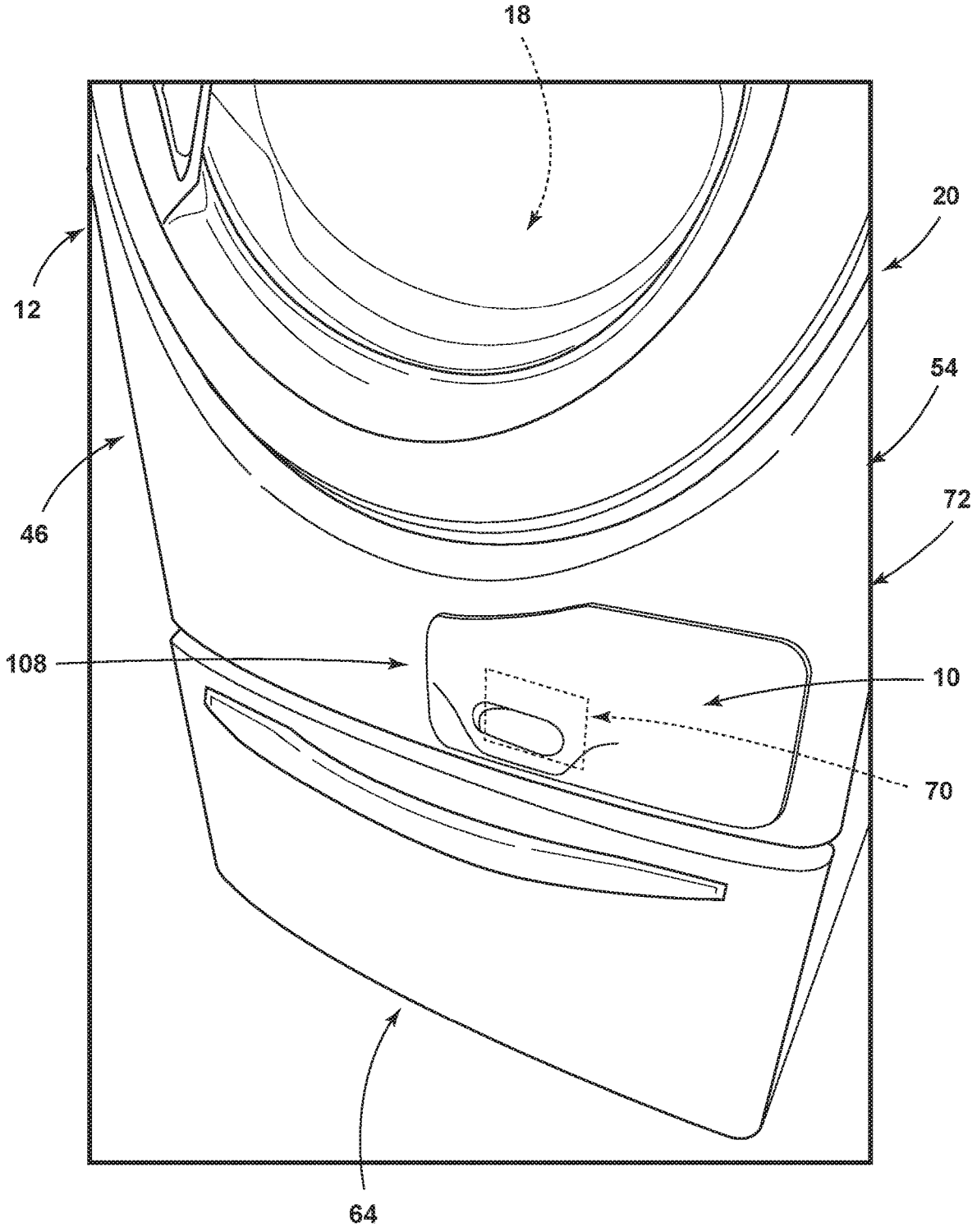
FIG. 1 is a front perspective view of a laundry appliance that incorporates an aspect of an accessory port.
Figure 2:
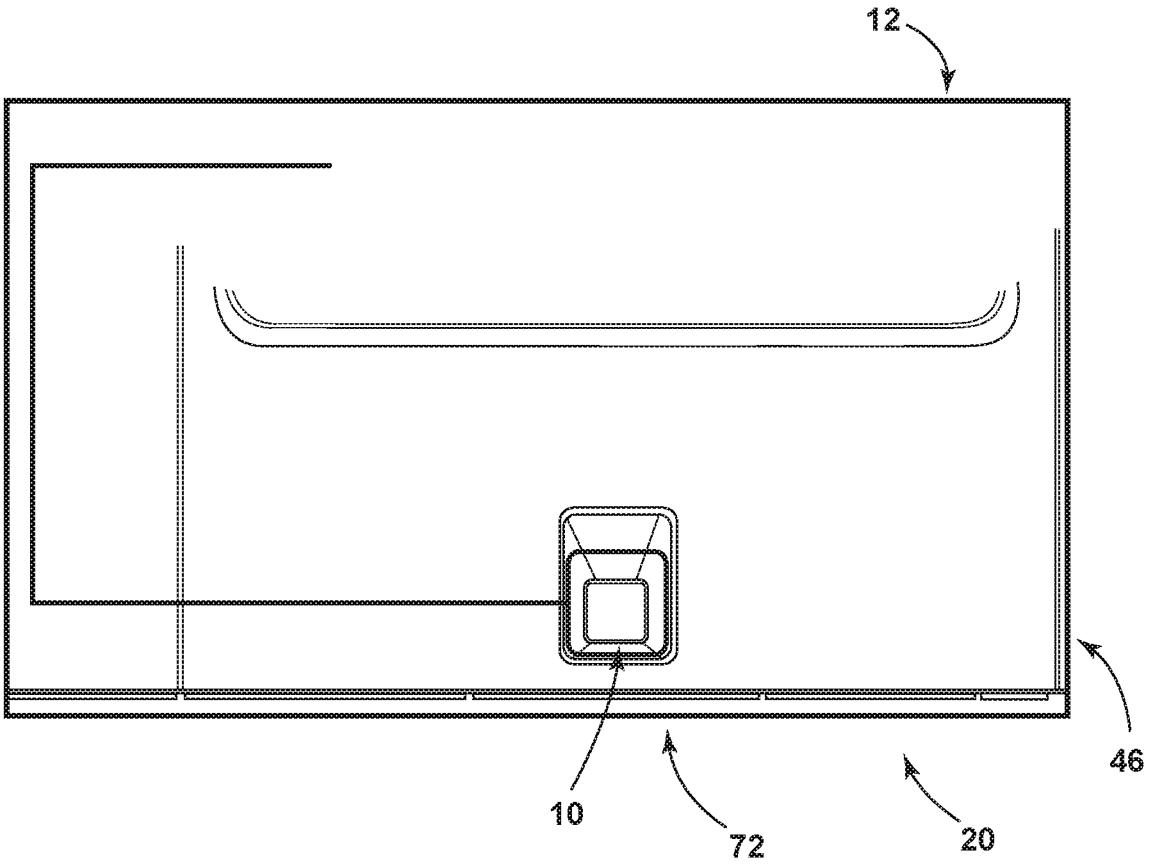
FIG. 2 is a front elevational view of an appliance that incorporates an aspect of the accessory port.
Figure 3:
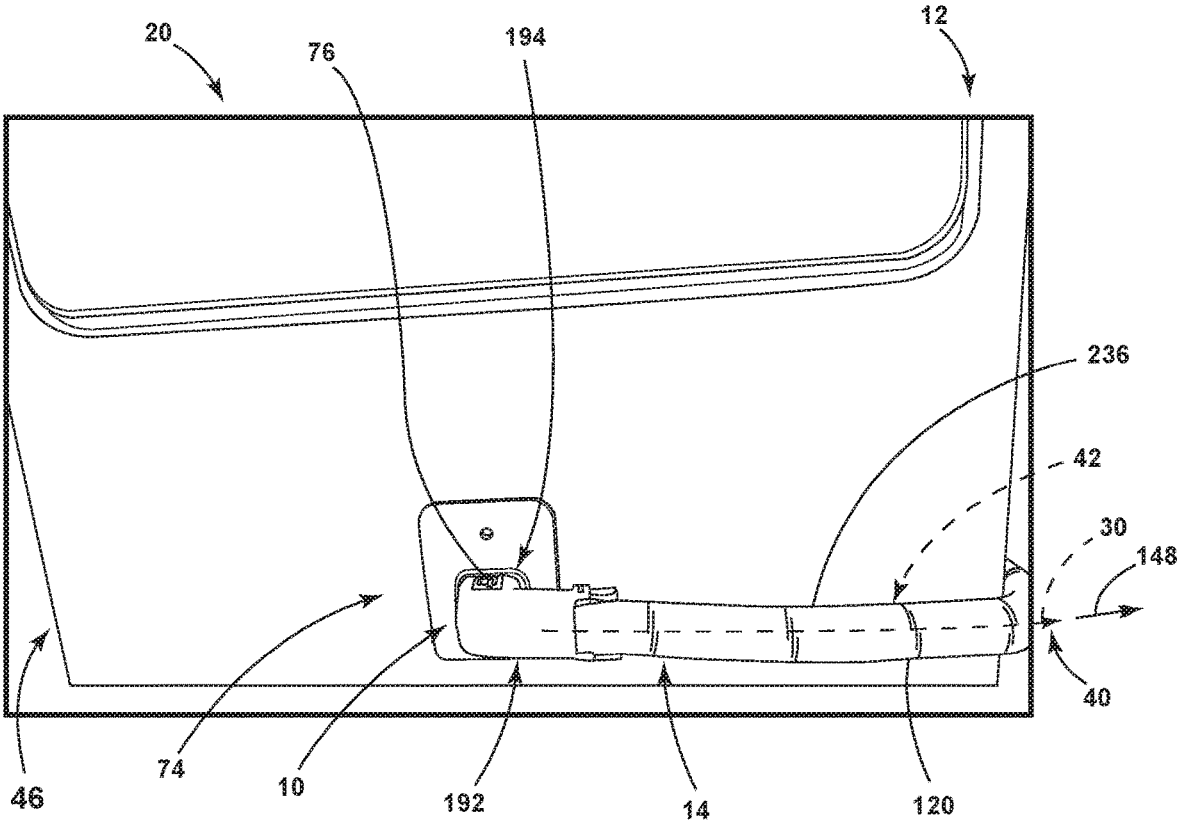
FIG. 3 is a front perspective view of the accessory port of FIG. 2 and showing an accessory tool coupled with the accessory port.
Figure 4:
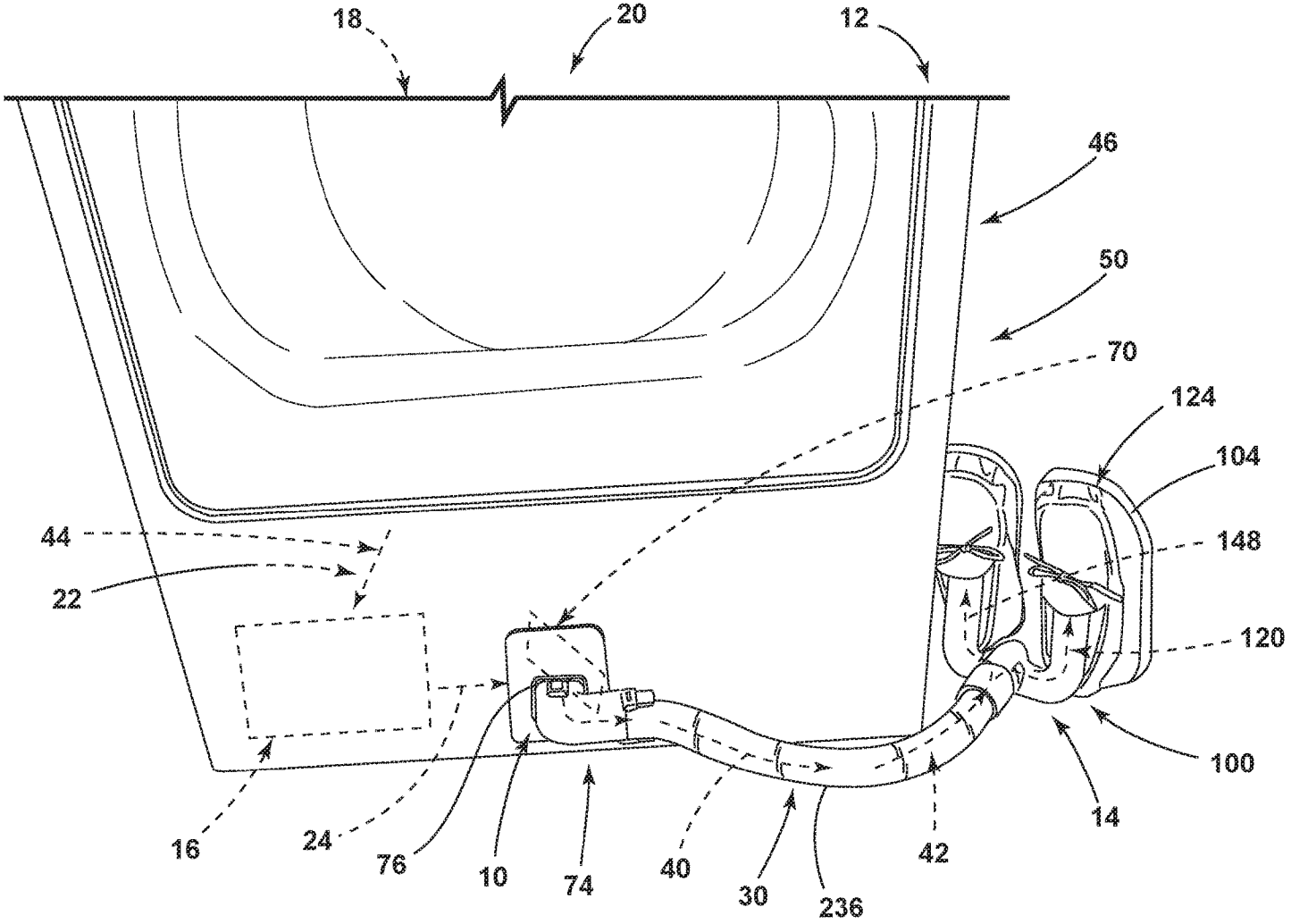
FIG. 4 is a front perspective view of the laundry appliance of FIG. 3 showing use of a shoe-drying accessory tool.
Figure 5:
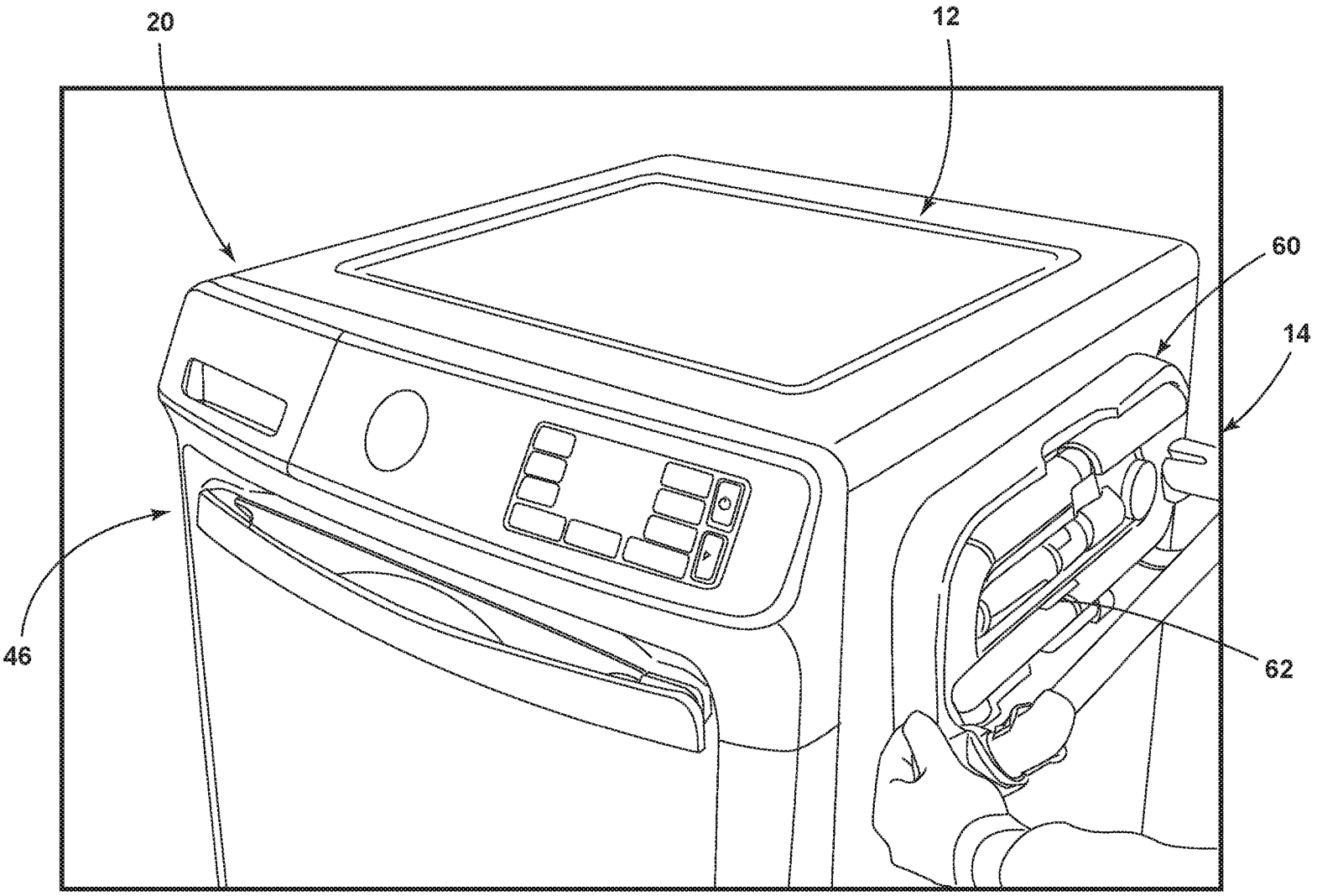
FIG. 5 is a front perspective view of a laundry appliance that incorporates a mounting device for storing a plurality of accessory tools.
Figure 6:
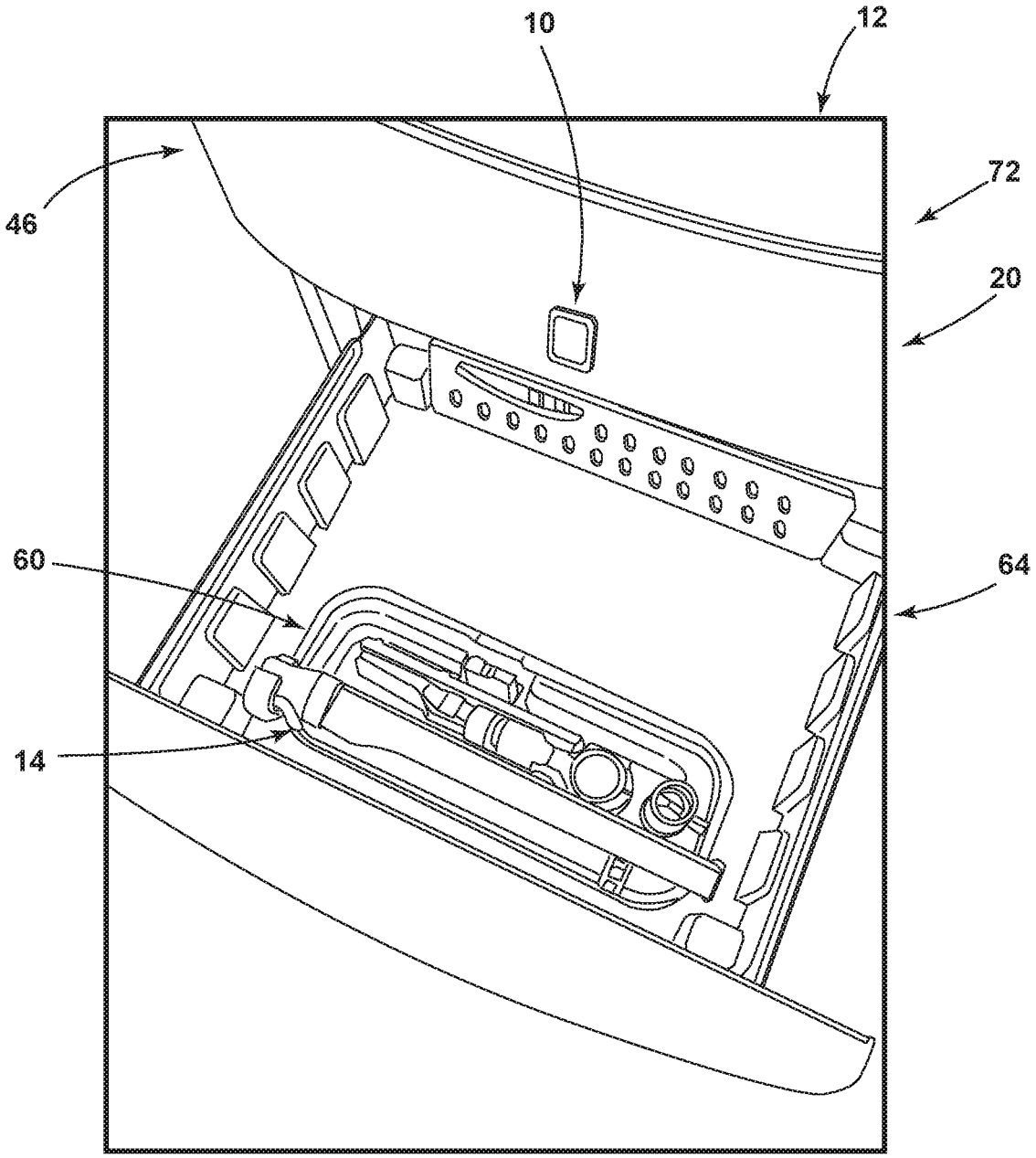
FIG. 6 is a top perspective view of a laundry appliance that includes a pedestal base for storing various accessory tools.
Figure 7:
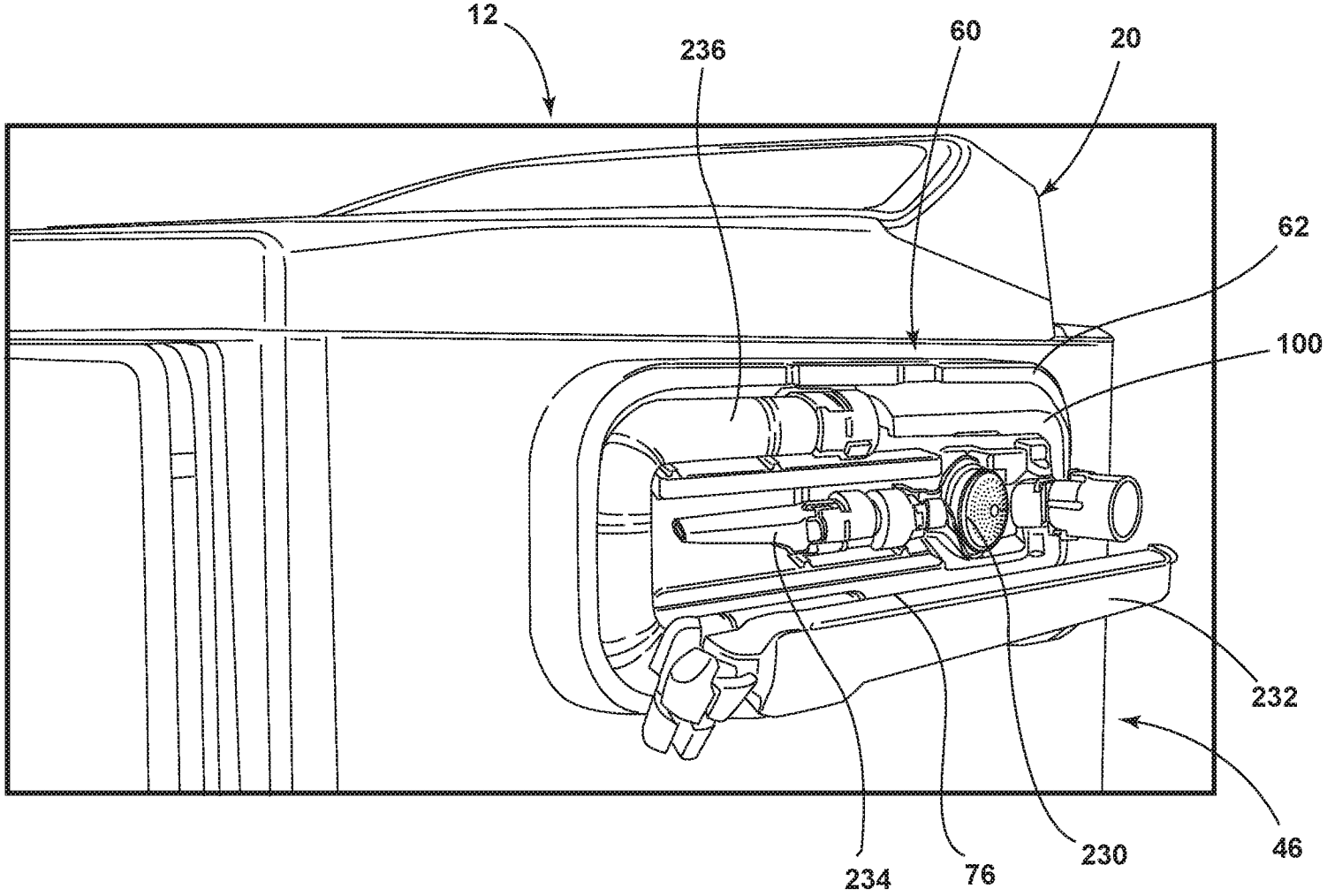
FIG. 7 is a side perspective view of a laundry appliance of FIG. 5.
Figure 8:
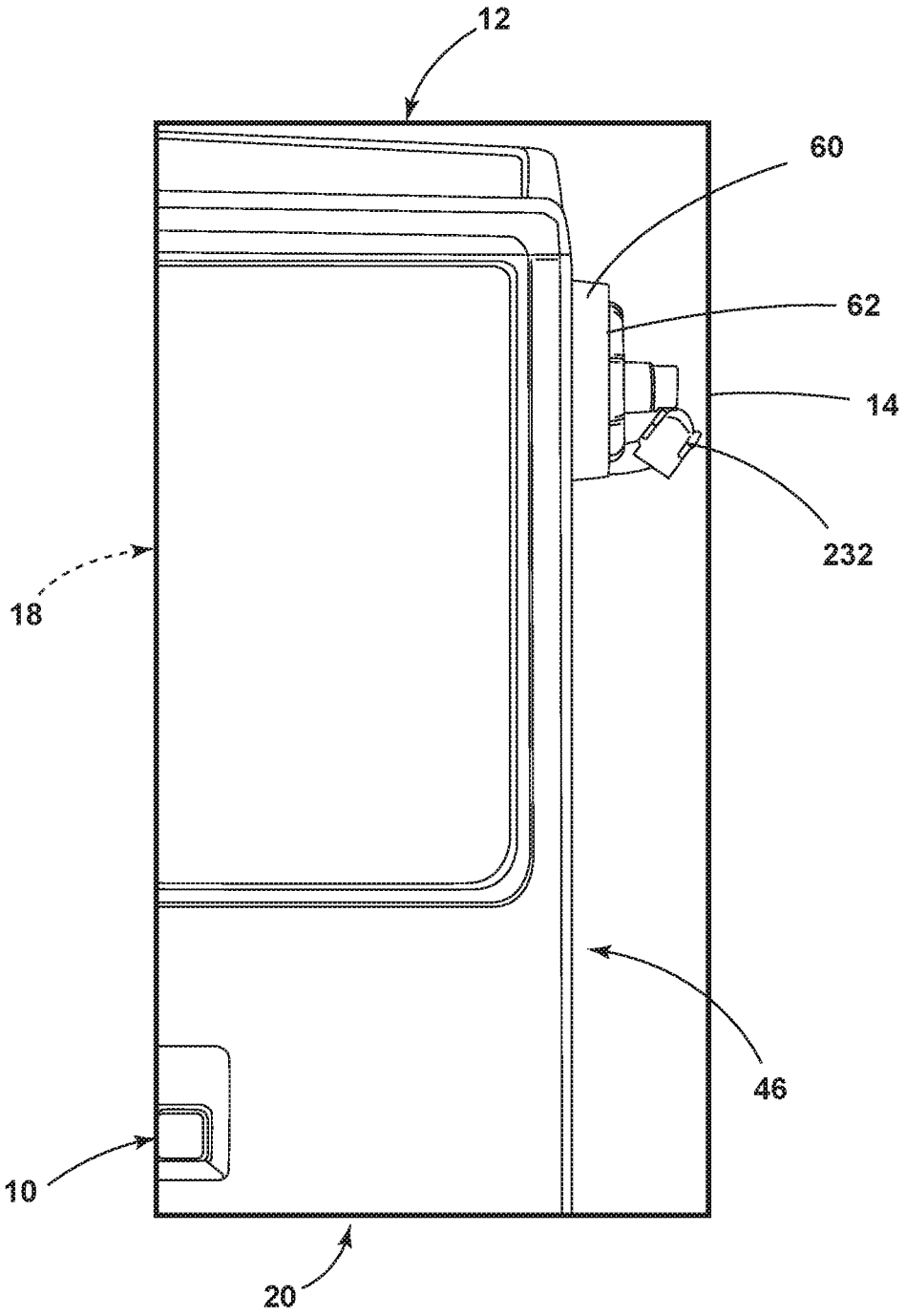
FIG. 8 is a front elevational view of the laundry appliance of FIG. 7.
Figure 9:
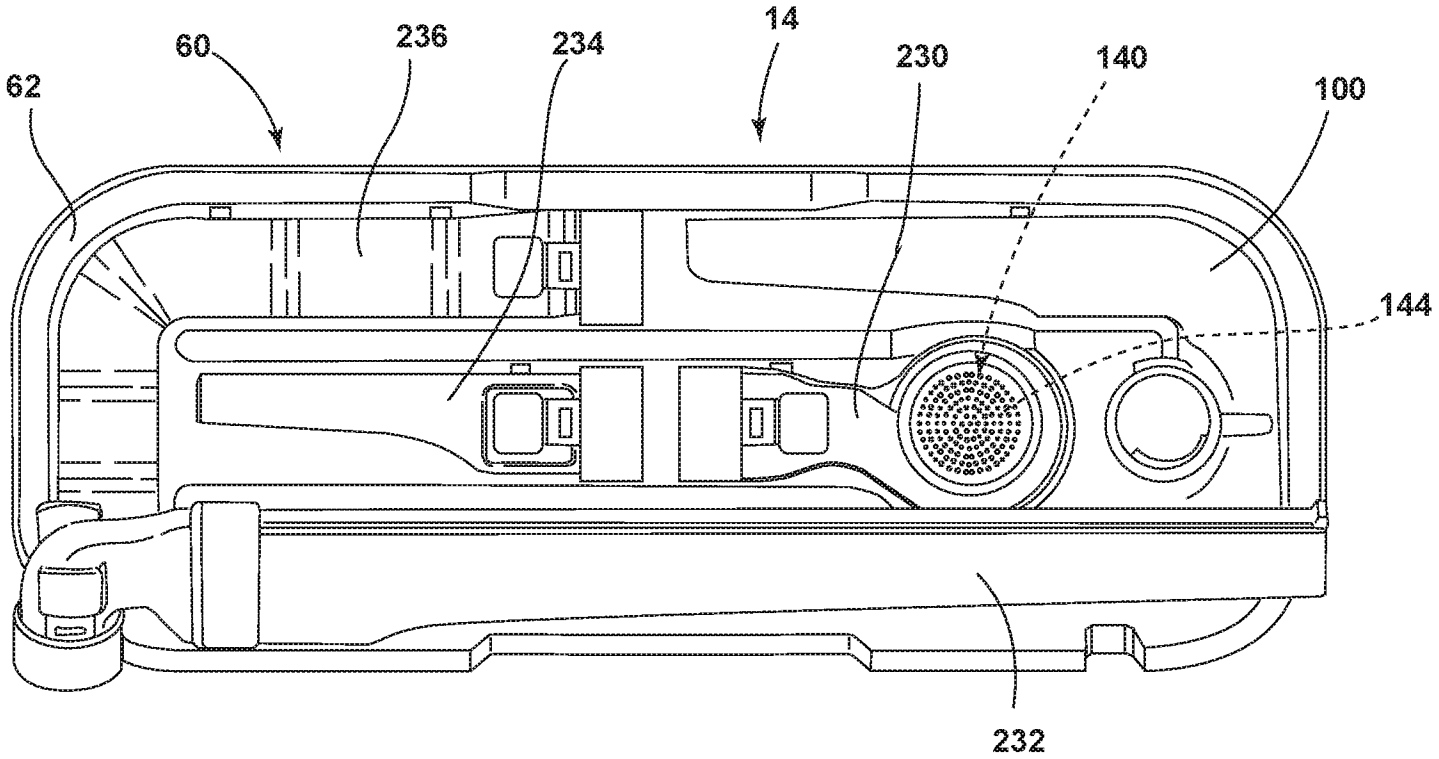
FIG. 9 is a side elevational view of the laundry appliance of FIG. 7.
Figure 10:
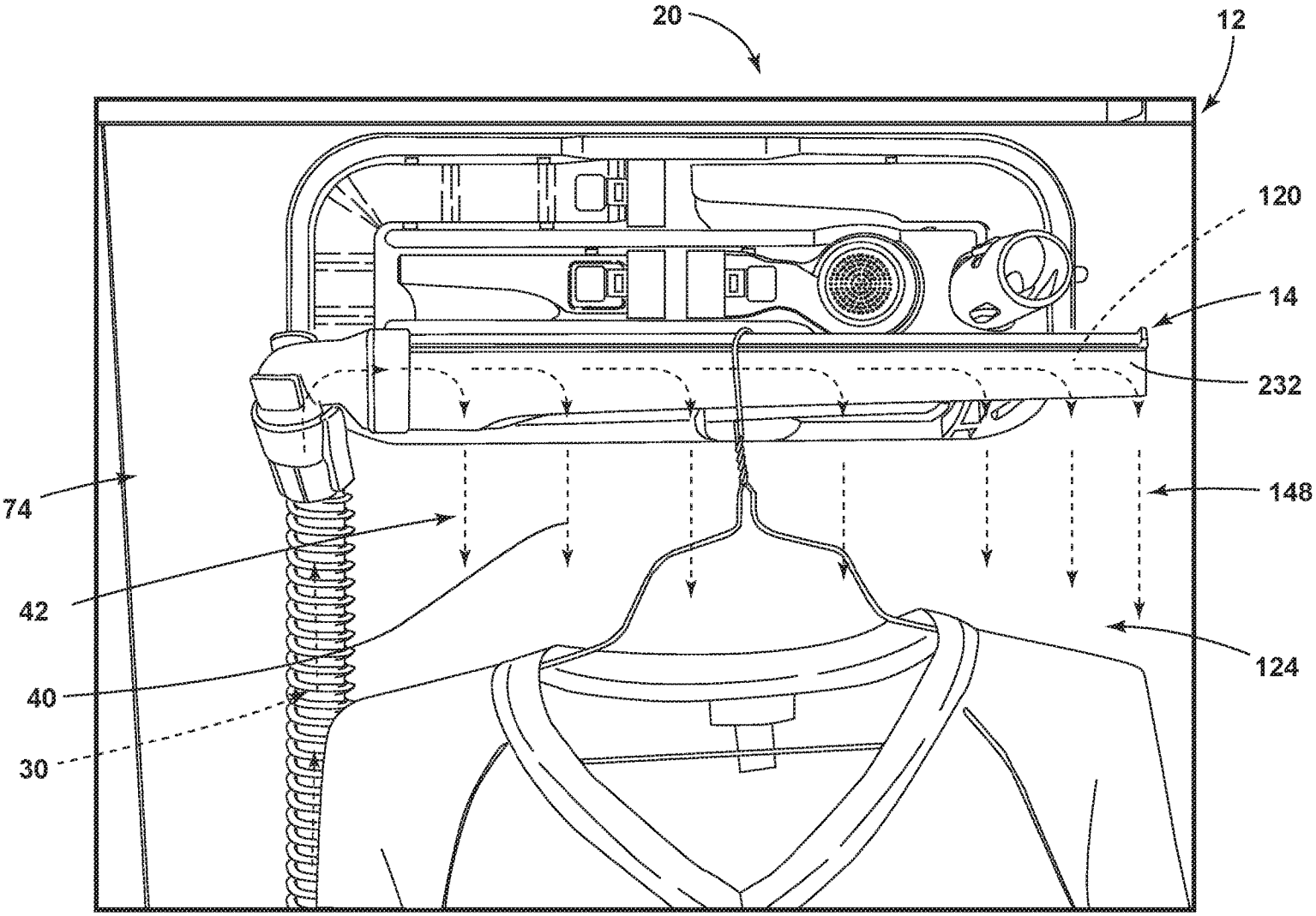
FIG. 10 is a side perspective view of an aspect of the laundry appliance of FIG. 7 that incorporates the accessory port and the accessory tools and showing use of a hanging clothes drying tool.
Figure 11:
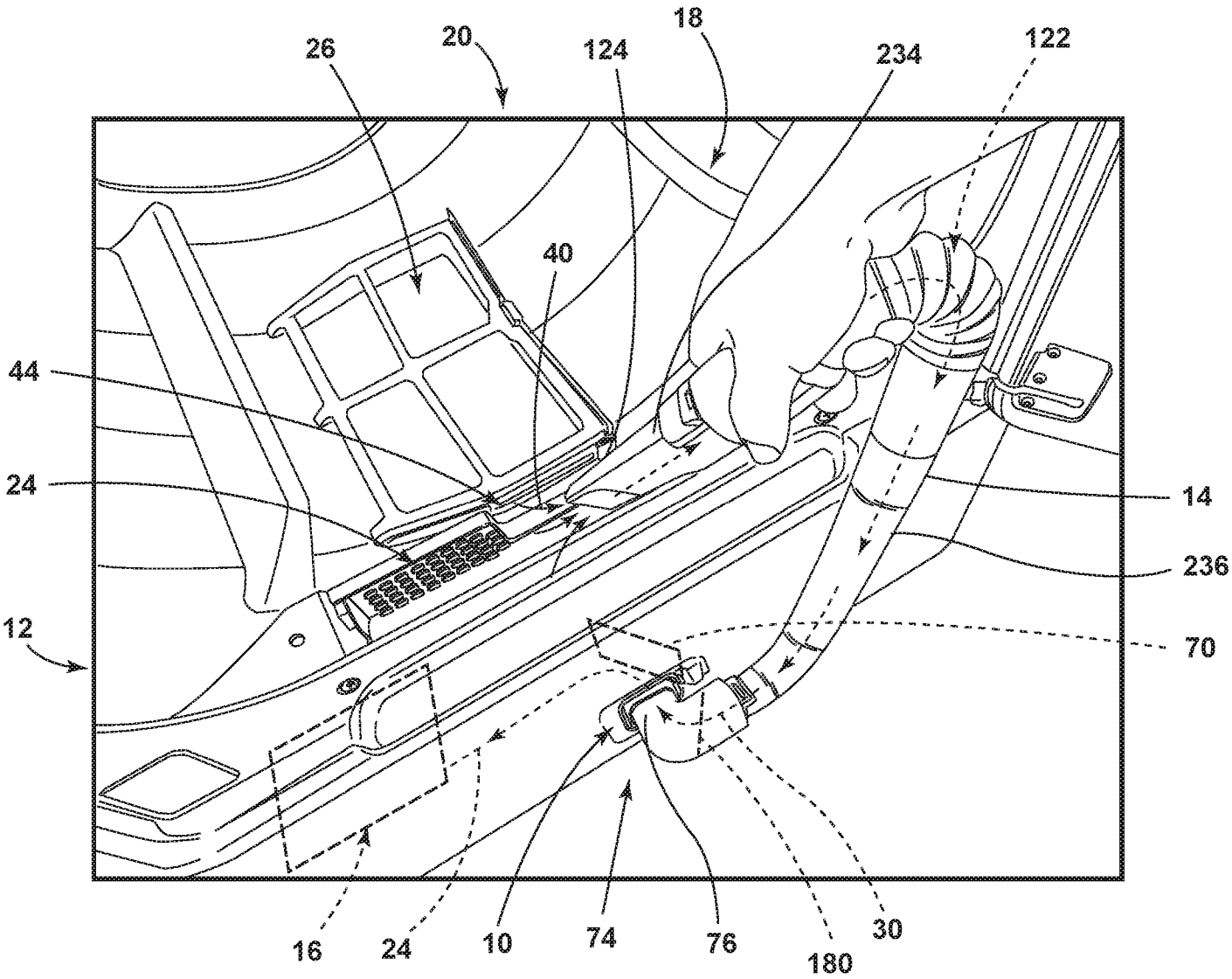
FIG. 11 is a top perspective view of an aspect of the laundry appliance showing operation of a vacuum tool.

The components in the figures are not necessarily to scale, emphasis instead being placed upon illustrating the principles described herein.

DETAILED DESCRIPTION

The present illustrated embodiments reside primarily in combinations of method steps and apparatus components related to a laundry appliance having an operable accessory port for providing air-related functions to areas around the appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 15:
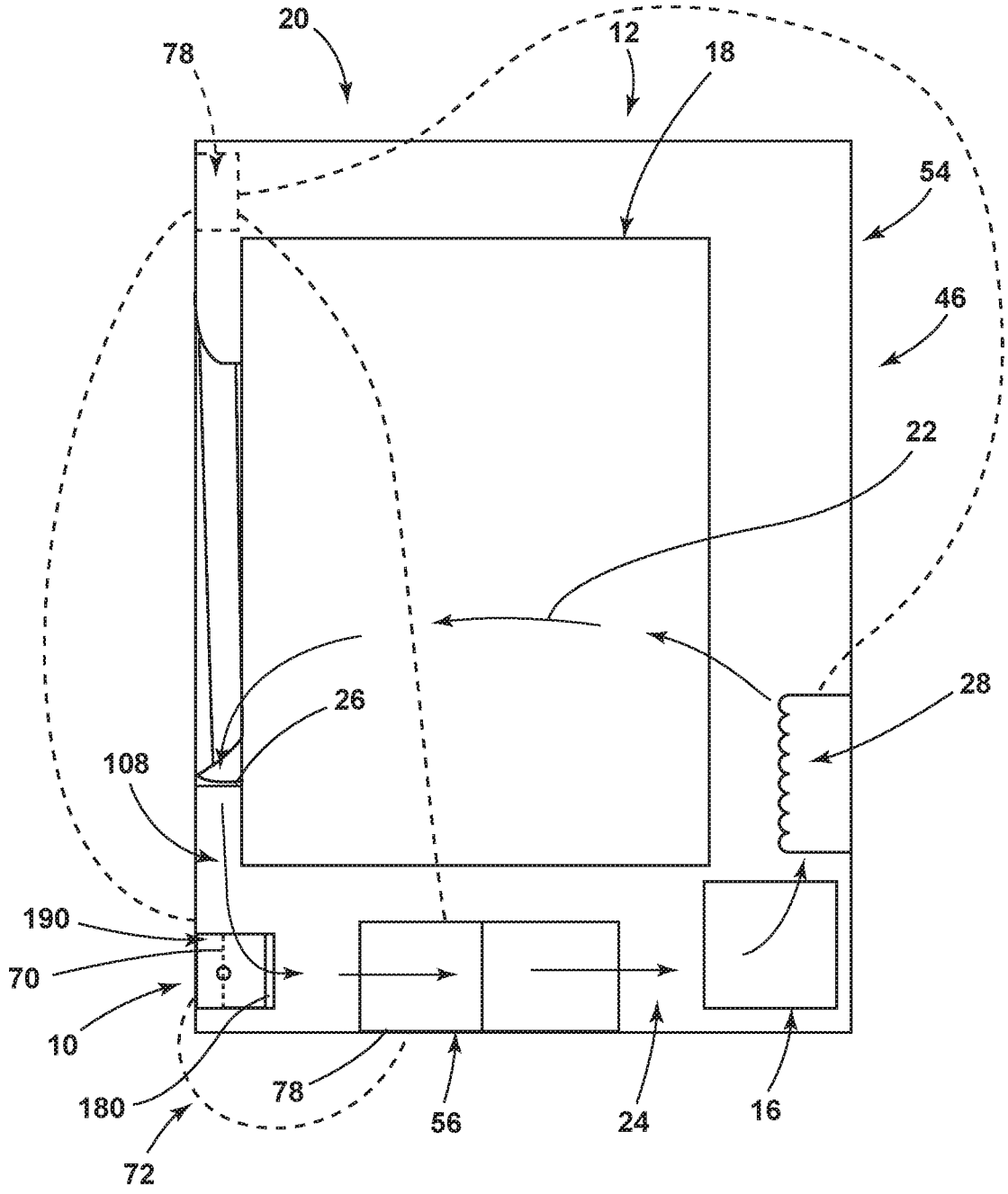
FIG. 15 is a schematic cross-sectional view of a recirculation-type drying appliance that incorporates an aspect of the accessory port and showing the accessory port in a standard operating position.

With respect to FIGS. 1-12, reference numeral 10 generally refers to an accessory port that is incorporated within a laundry appliance 12, where the accessory port 10 can be used for powering various external accessory tools 14. These external accessory tools 14 are typically powered by the blower 16 that is incorporated within the laundry appliance 12. Collectively, these accessory tools 14 can be used to provide various air-powered functionalities within, around and external to the rotating drum 18 that is incorporated within the laundry appliance 12. According to various aspects of the device, the laundry appliance 12, typically a dryer 20 or combination washer and dryer, includes a blower 16 that delivers process air 22 through an airflow path 24. The airflow path 24 typically moves from the blower 16, through the rotating drum 18 or other processing chamber, then through one or more filtration devices 26 and back to the blower 16. One or more heating elements 28 (shown in FIGS. 15 and 16) can be incorporated within the airflow path 24 for providing temperature variation within the process air 22 delivered through the appliance 12. An accessory port 10 is coupled with the airflow path 24 and is accessible from an exterior surface of a structural cabinet 46 for the appliance 12. The accessory port 10 selectively redirects the process air 22 through an accessory airflow path 30.

An accessory tool 14 is configured to selectively engage the accessory port 10 to define the accessory airflow path 30. In this manner, when the accessory tool 14 is coupled with the accessory port 10, the process air 22 delivered by the blower 16 moves through the accessory port 10 for providing functionality at a particular point using the accessory tool 14. The various accessory tools 14 can include one or more air-powered tools that can utilize the movement of process air 22 or accessory process air 40 for accomplishing certain tasks within and around the laundry appliance 12. Typically, these accessory tools 14 utilize the process air 22 in the form of a positive airflow 42 (i.e., blowing air 148) or negative airflow 44 (i.e., vacuum) as will be described more fully below.

Referring now to FIGS. 1-19, the drying appliance 12 that incorporates the accessory port 10 can be in the form of a venting dryer 50 (shown in FIGS. 17-19), where the blower 16 moves process air 22 through the rotating drum 18, through a filtration device 26, and then to a vent 52 where the process air 22 exits the laundry appliance 12 and, typically, exits the structure housing the appliance 12. The drying appliance 12 can also be in the form of a recirculating dryer 54 (shown in FIGS. 15 and 16) that includes a thermal exchanging mechanism 56 such as a heat pump, heat exchanger, or other thermal transfer device. In the recirculating dryer 54, process air 22 is recirculated as a recirculating flow of process air 22 through the recirculating airflow path 24 from the blower 16, through the rotating drum 18, past one or more filtration devices 26, and then returned to the blower 16 to be recirculated through the airflow path 24. In either of these instances, the accessory port 10 can be incorporated within the airflow path 24. In this manner, the accessory tool 14 can be coupled with the accessory port 10 for redirecting the process air 22 for use within and around the appliance 12 via the accessory tools 14.

As exemplified in FIGS. 5-9, the various accessory tools 14 can be attached to a storage device 60 that is attached to or incorporated within the appliance 12. The storage device 60 for the accessory tools 14 can take the form of a side-mounted frame 62 that receives the various accessory tools 14 for organizational purposes. The storage device 60 can also be incorporated within a pedestal 64 or other similar base of the appliance 12. In these various instances, the accessory tools 14 are readily accessible for use in combination with the accessory port 10.

Referring now to FIGS. 15, 16 and 20-20B, where the laundry appliance 12 is a recirculating dryer 54, the accessory port 10 can include an internal baffle 70 that can be operated to convert the airflow path 24 from a standard state 72 to an accessory state 74. In the standard state 72, the recirculating dryer 54 operates according to typical operating conditions where clothes are dried within the rotating drum 18. Conversely, in the accessory state 74, the process air 22 is redirected from the accessory port 10 and through the accessory tool 14 for providing air-related functionality to areas within and around the laundry appliance 12. Where the baffle 70 is incorporated, the baffle 70 can be selectively biased between the standard state 72, indicative of a standard or conventional operation condition, to an accessory state 74, indicative of the accessory port 10 receiving an accessory tool 14, through the insertion and extraction of the interface 76 for the accessory tool 14. When the interface 76 for the accessory tool 14 is inserted within the accessory port 10, the baffle 70 is operated from the standard state 72 and to the accessory state 74. In the standard state 72, as exemplified in FIG. 15, the airflow path 24 extends from the blower 16, through the rotating drum 18, past the accessory port 10, in the standard state 72, and back to the blower 16. As discussed above, various temperature control mechanisms 78, in the form of heating and cooling devices, can be disposed within and around the airflow path 24.

The interface 76 engages a baffle actuator 80 that biases the baffle 70 to the accessory state 74. The baffle 70 is slidably operable within the accessory port 10 and is biased by a biasing mechanism toward the standard state 72. Accordingly, the baffle 70 automatically returns to the standard state 72 when the interface 76 of the accessory tool 14 is removed from the accessory port 10. The baffle actuator 80 can be a linkage that is physically moved by the insertion or other installation of the interface 76 for the accessory tool 14 into the accessory port 10. The baffle actuator 80 can also be a motorized or automatically operated member, such as diverter valve 210, which is described more fully herein.

Figure 16:
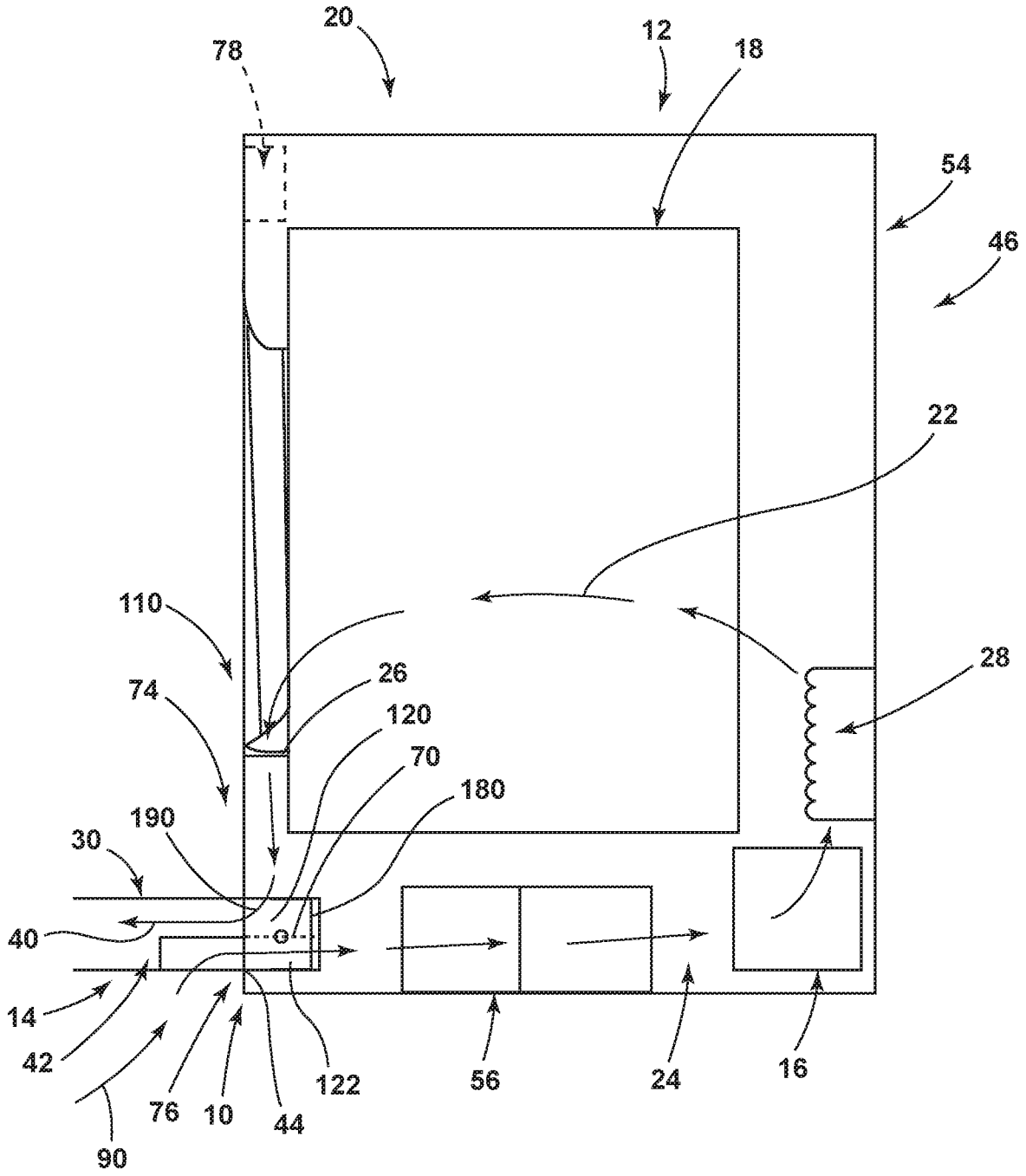
FIG. 16 is a schematic cross-sectional view of the appliance of FIG. 15 and showing an accessory position of the accessory port.

As exemplified in FIG. 16, when the interface 76 for the accessory tool 14 is coupled with the accessory port 10, the accessory interface 192 biases the baffle 70 to the accessory state 74 and the airflow path 24 is redirected to move through the accessory tool 14. Within the appliance 12, the airflow path 24 in the accessory state 74 is generally similar to those portions of the airflow path 24 within the appliance 12 in the standard state 72. In this manner, as the blower 16 operates, process air 22 is moved from the blower 16, through the rotating drum 18 and toward the accessory port 10. In the accessory state 74, the accessory port 10 directs this process air 22 from the airflow path 24 and toward the accessory tool 14 to define the accessory airflow path 30. In this manner, the positive airflow 42, having a positive pressure generated downstream of the blower 16, is pushed through the accessory port 10 and through the accessory tool 14. The negative airflow 44 having a negative pressure or suction which is drawn in by the blower 16, is also drawn in through the accessory port 10 and back toward the blower 16. Accordingly, in the accessory state 74, the process air 22 moves from the blower 16, through the rotating drum 18 and into the accessory tool 14 via the accessory port 10 as positive airflow 42. Accessory process air 40 of a negative airflow 44 is drawn into the accessory port 10 via the accessory tool 14 and is drawn toward the blower 16. Typically, the process air 22 from the rotating drum 18 is moved through the accessory tool 14 and is expressed from a portion of the accessory tool 14. Similarly, the negative airflow 44 that is drawn by the blower 16 is typically fresh air 90 that is drawn in from areas outside of the appliance 12 and is drawn towards the blower 16.

Figure 13:
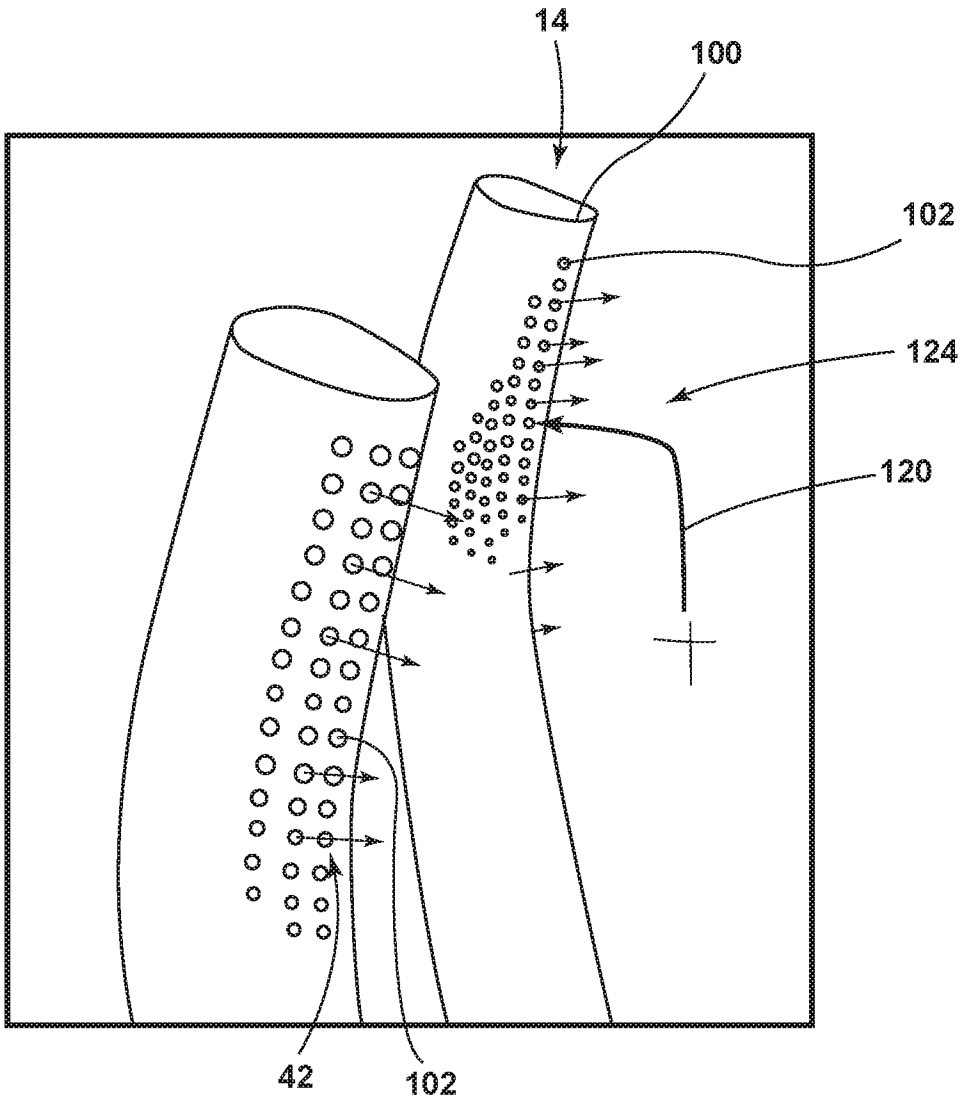
FIG. 13 is an enlarged perspective view of an aspect of the shoe-drying tool.
Figure 14:
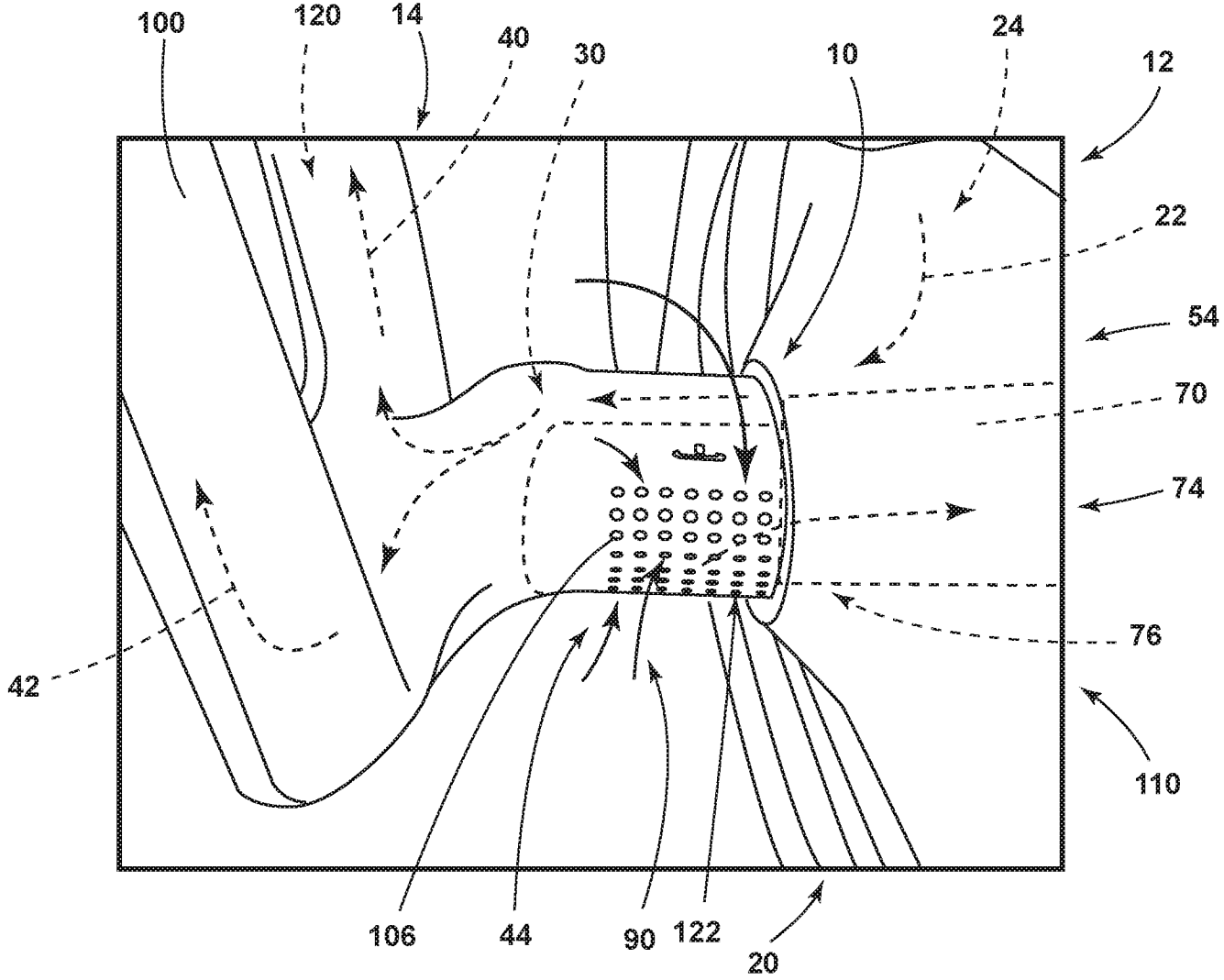
FIG. 14 is another side perspective view of an aspect of the shoe-drying tool of FIG. 13.

Referring now to FIGS. 13 and 14, the shoe-drying attachment 100 for a recirculating dryer 54 is exemplified. Within FIG. 13, air outlet ports 102 are shown as providing for a positive airflow 42 that leaves these air outlet ports 102 and is directed to the external environment to define a blowing-related tool. In this manner, the air outlet ports 102 can be used for drying the interior of shoes 104, in a configuration similar to that shown in FIG. 4. Typically, this shoe-drying attachment 100 will be utilized with the recirculation dryer 20 such that the accessory tool 14 accommodates both positive airflow 42 and negative airflow 44 within the accessory airflow path 30 of the accessory tool 14 and the recirculation dryer 20, although the shoe-drying attachment 100 can also be used in a venting dryer 50 as well. FIG. 14 shows the direction of the negative airflow 44 through the air inlet ports 106. These air inlet ports 106 draw in external fresh air 90 from the environment through the accessory port 10 and back toward the blower 16 so that the air inlet ports 106 of the accessory tool 14 defines a suction-related tool. Through this configuration, the airflow path 24 of the recirculating dryer 54 in the standard state 72 is typically a closed system 108, where the process air 22 moves continually through a closed airflow path 24. In the accessory state 74 of the accessory port 10, the airflow path 24 becomes an open system 110 where the accessory tool 14 provides for the expression of positive airflow 42 or blowing air 148 and the intake of negative airflow 44 or suction air 150, typically outside air, that provides for movement of the process air 22 through the airflow path 24.

Figure 24:
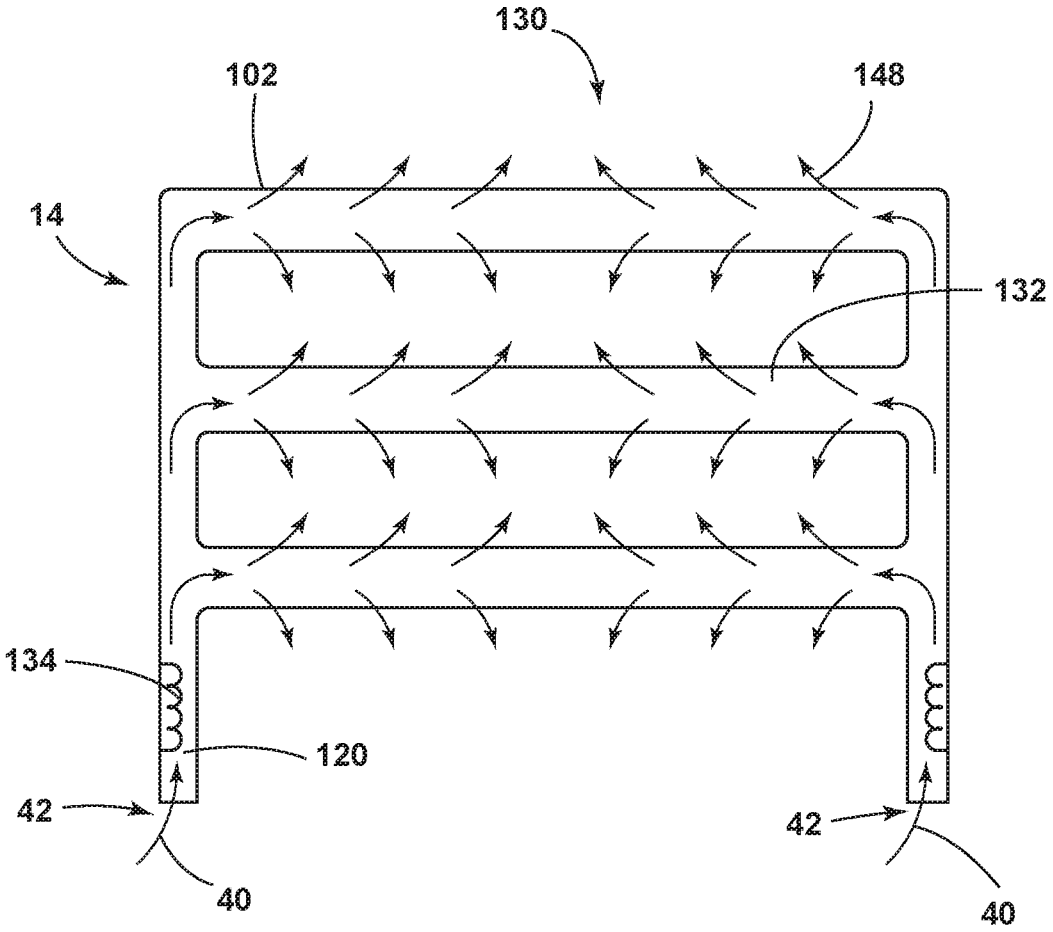
FIG. 24 is a schematic diagram of an aspect of a drying rack that can be coupled with the accessory port of an appliance.
Figure 25:
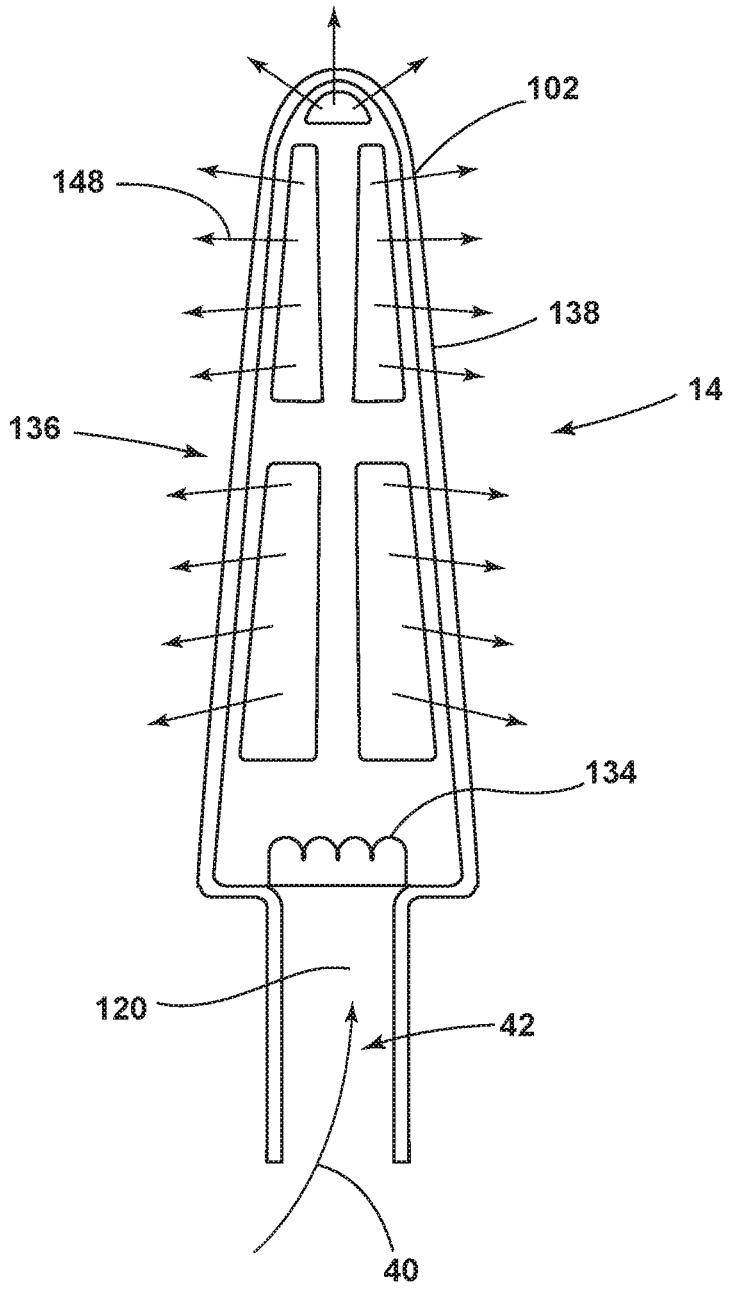
FIG. 25 is a cross-sectional schematic view of an aspect of a drying post attachment that can be coupled with the accessory port for an appliance.

Referring now to FIGS. 24 and 25, the accessory tools 14 can also include a rack attachment 130 as exemplified in FIG. 24. The rack attachment 130 can include a number of rungs 132 that include various air outlet ports 102 through which blowing air 148 can be used to dry damp articles while hanging from the rungs 132. The rack attachment 130 can also include a heater 134 that heats the blowing air 148. Various sensors 190 can be included in the various attachments 14 to adjust the temperature of the accessory process air 40 that is directed to the attachment 14 via the accessory port 10. In addition, the accessory tools 14 can include a hanger attachment 136 that directs the blowing air 148 to air outlet ports 102 that are positioned on a hanger surface 138. The blowing air 148 is directed through the air outlet ports 102 to assist in the drying of damp articles. The hanger attachment 136 can also include a heater 134 for modifying the temperature of the accessory process air 40. The accessory tools 14 described herein are configured to be connected to the appliance 12 via the accessory port 10 to selectively deliver accessory process air 40 to the accessory tools 14 that are positioned external to the appliance 12.

Referring again to FIGS. 15 and 16, the accessory port 10 shown in FIG. 15 is exemplary of the standard state 72 where the process air 22 moves from the rotating drum 18, past the baffle 70 of the accessory port 10 and returns to the blower 16. As shown in FIG. 16, when the baffle 70 is rotated to define the accessory state 74, the baffle 70 separates the accessory port 10 into a positive airflow path 120 and a negative airflow path 122. The positive airflow path 120 directs the process air 22 out from the accessory port 10 and through the accessory tool 14. The negative airflow path 122 draws suction air 150 in from the accessory tool 14, through the accessory port 10 and back to the blower 16. Depending upon what type of air is required at the function site 124 of the accessory tool 14, the positive airflow 42 (blowing accessory air) or the negative airflow 44 (suction accessory air) may be directed to this function site 124.

By way of example, and not limitation, where the accessory tool 14 is a vacuum, blowing air 148 will typically be expressed from the positive airflow path 120 of the accessory tool 14 at a location near the accessory port 10. Conversely, to utilize the negative airflow 44 or suction air 150, generated by the blower 16 and the accessory port 10 in the accessory state 74, the suction air 150 will extend through the negative airflow path 122 and to the end of the accessory tool 14 to allow for a vacuum-type functionality to be utilized by the blower 16 of the laundry appliance 12. In another exemplary embodiment, where the accessory tool 14 is a blowing-type tool, such as the shoe-drying attachment 100 described above, the positive airflow path 120 will be directed to the function site 124 of the accessory tool 14 for providing blowing-type air where it is needed to perform the function of the particular accessory tool 14. The negative pressure air, or suction air 150, will be drawn into the accessory tool 14 at a location typically near the accessory port 10 so that the suction air 150 can be delivered into the negative airflow path 122 and back to the blower 16.

Figure 12:
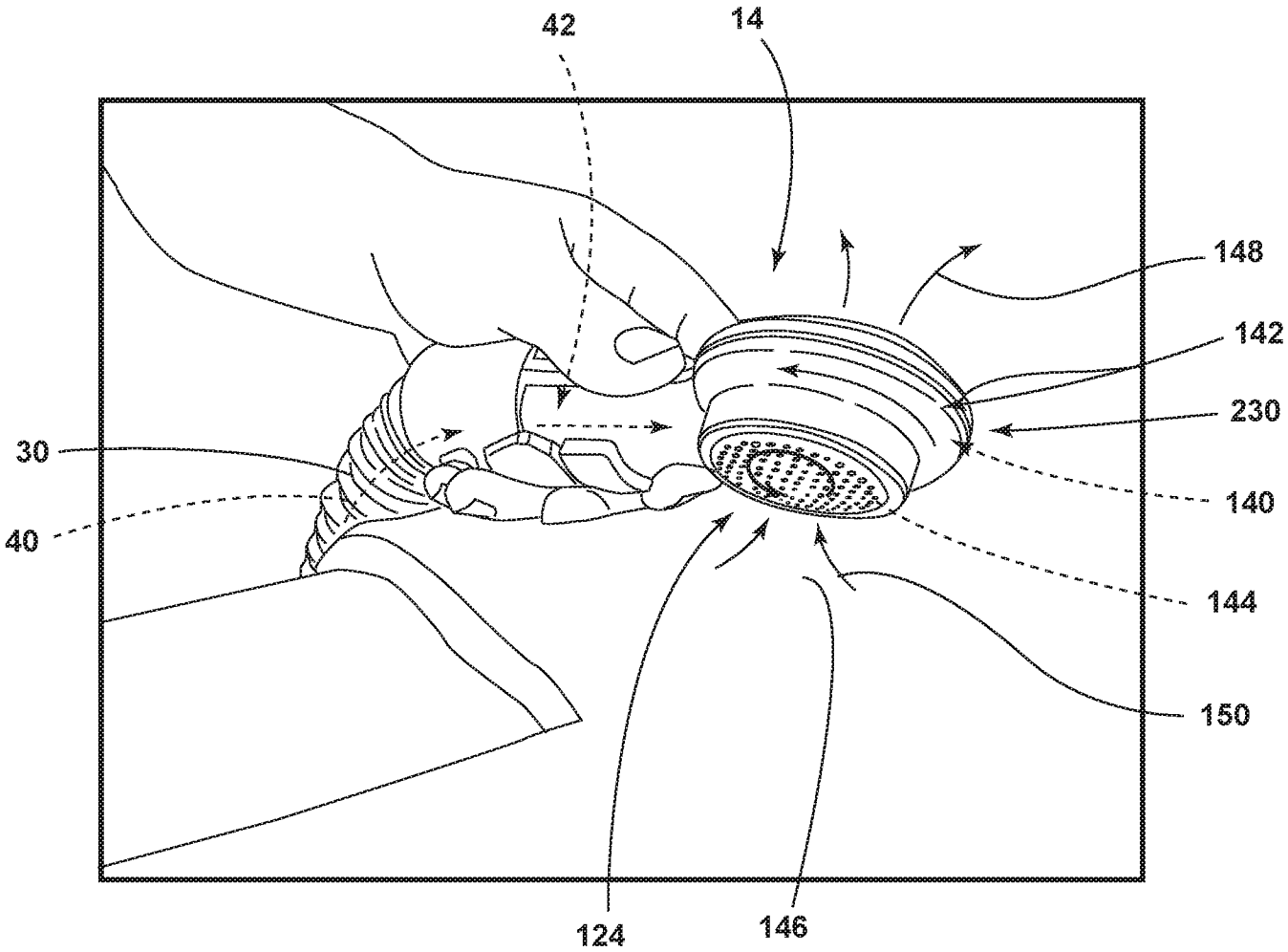
FIG. 12 is a perspective view of a lint removal tool that can be coupled with the accessory port for the appliance.
Figure 21:
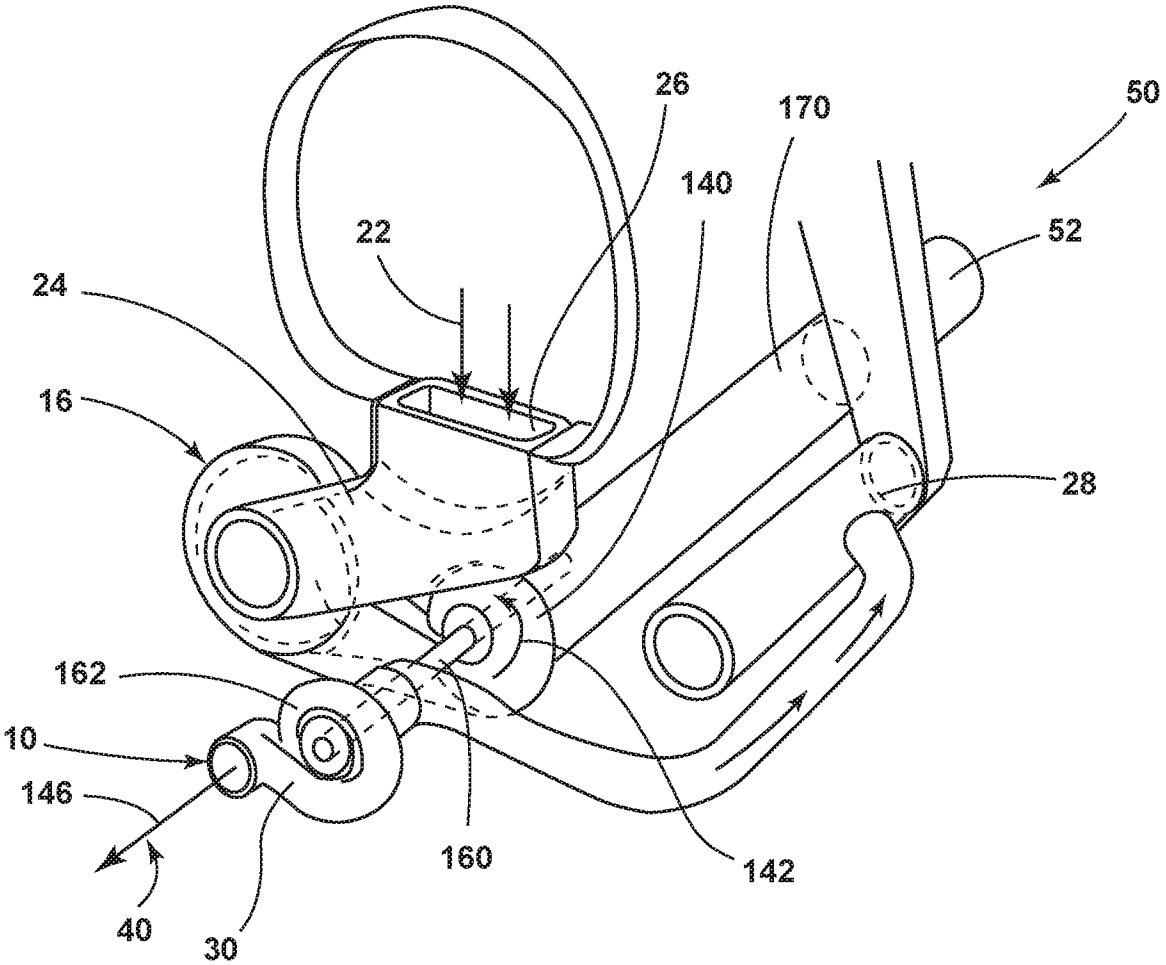
FIG. 21 is a schematic cross-sectional view of an accessory port and internal turbine that is used in combination with an accessory-type drying appliance.

According to various aspects of the device, as illustrated in FIGS. 12 and 21, various accessory tools 14 or the appliance 12 can include an internal turbine 140 that can be used with venting dryers 50 and/or recirculating dryers 54. This internal turbine 140 can be operated using the accessory process air 40 that moves through the accessory tool 14. This accessory process air 40 passes over or through the turbine 140, for causing a rotational operation 142 of the turbine 140. By rotating the turbine 140, one or more functions can be accomplished at the turbine 140. In at least one instance, the turbine 140 can include a number of cutting blades 144 that can be used as a lint removal device, sweater de-baller, or other similar laundry maintenance device for removing loose string, lint and other undesirable material that accumulates as a result of various drying operations. At the same time, the turbine 140 can also generate a secondary airflow 146 that may be directed along a rotational axis of the turbine 140 and in a direction generally perpendicular to the accessory airflow path 30. This secondary airflow 146 may generate blowing air 148 and suction air 150 that can be used at a function site 124 of the accessory tool 14. The suction air 150 generated by the turbine 140 and the cutting blades 144 can be used to draw the severed pieces of lint and fabric away from the clothing item. These cut pieces of lint and fabric can be collected in a separate storage container within the de-fuzzing attachment 230.

Referring now to FIG. 21, as shown in this schematic diagram, the turbine 140 is positioned within the appliance 12 and near the blower 16. As the blower 16 operates, the process air 22 causes the turbine 140 to rotate. A shaft 160 extending from the turbine 140 to a compressor wheel 162 is rotated due to the rotation of the turbine 140 caused by the movement of process air 22. This compressor wheel 162 can be used to cause a secondary airflow 146 of accessory process air 40 that can be utilized within the appliance 12 or within separate portions of the appliance 12. As exemplified in FIG. 21, the accessory process air 40 can be moved from the compressor wheel 162, through a heating element 28 and used in other portions of the appliance 12 that are external to the appliance 12.

Within a venting dryer 50, where blowing air 148 is utilized through the airflow path 24, the turbine 140 can be incorporated to provide additional functionality. In the venting dryer 50, the turbine 140 can be utilized for creating a separate flow of accessory process air 40 that can be in the form of an accessory blowing air 148 or an accessory suction air 150 that can be utilized by the various accessory tools 14. In various aspects of the device, the compressor wheel 162 can be positioned at or near the accessory port 10 for allowing a user to connect the accessory tool 14 with the blowing air 148 or the suction air 150 at the compressor wheel 162.

Figure 17:
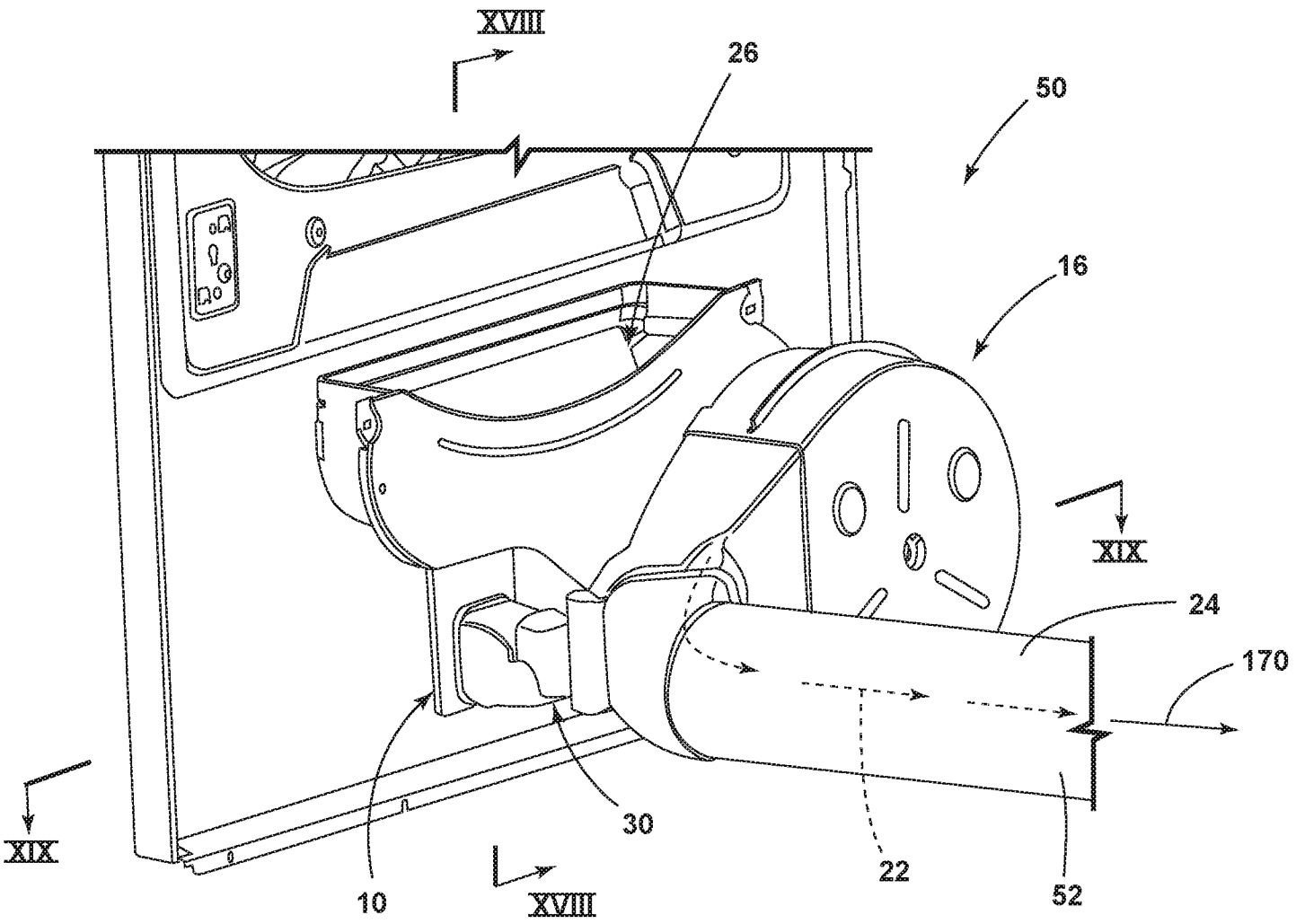
FIG. 17 is a schematic perspective view of an interior of the drying appliance and showing an aspect of the accessory port.
Figure 18:
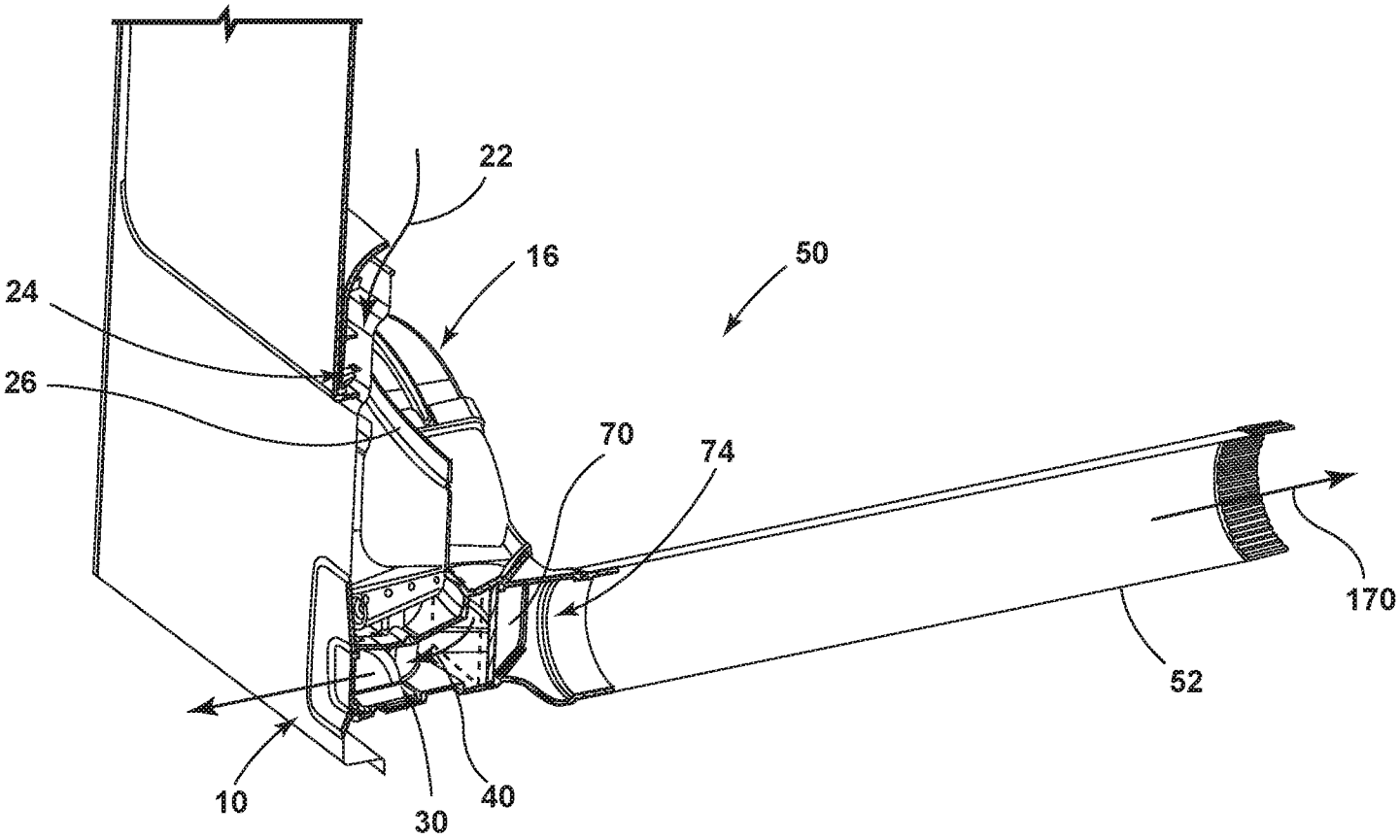
FIG. 18 is a cross-sectional view of the laundry appliance of FIG. 17 taken along line XVIII-XVIII.
Figure 19:
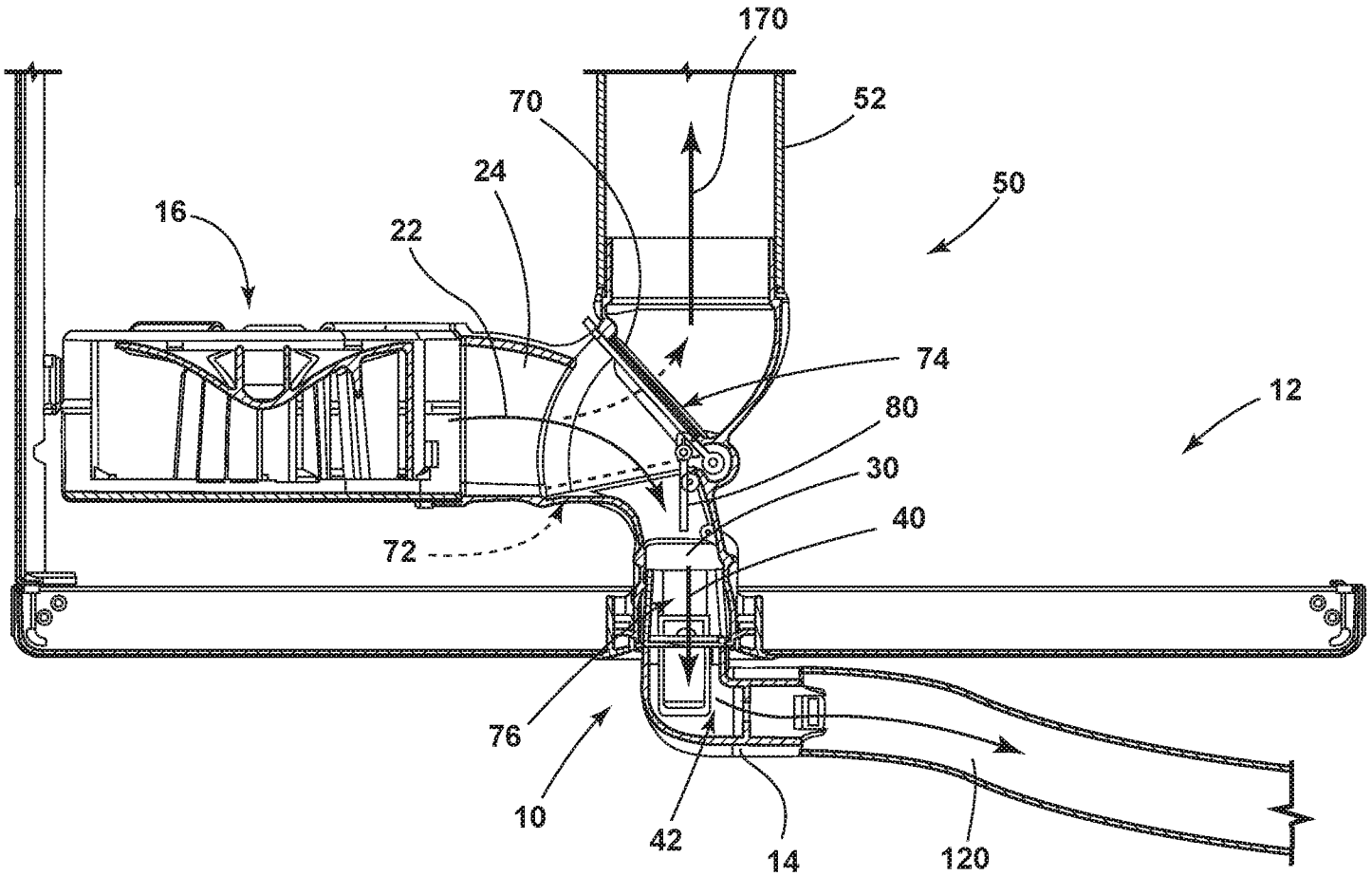
FIG. 19 is a cross-sectional view of the laundry appliance of FIG. 17 taken along line XIX-XIX.
Figure 20:
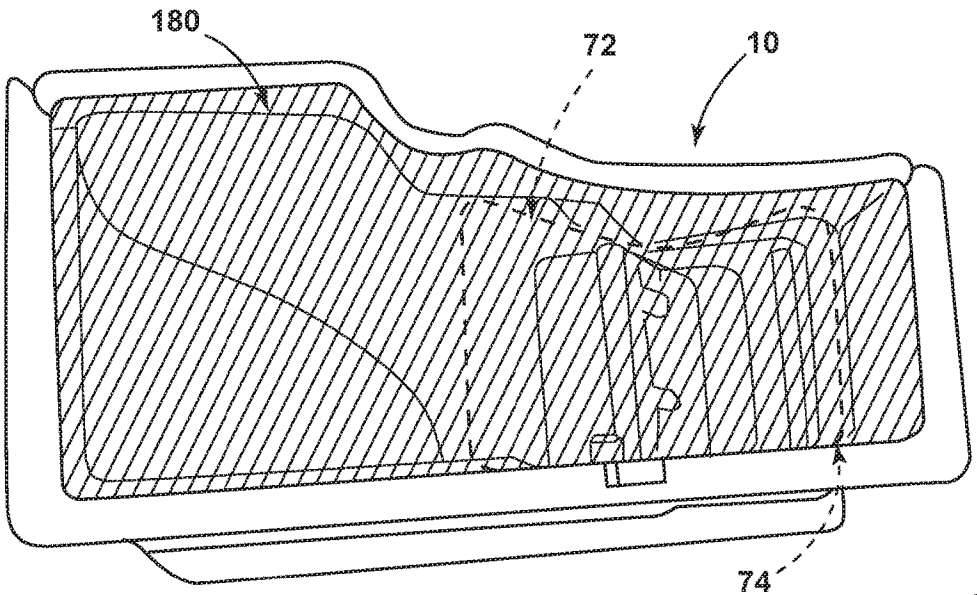
FIG. 20 is a perspective view of an aspect of a baffle for the accessory port that operates between a standard state and an accessory state.
Figure 20B:
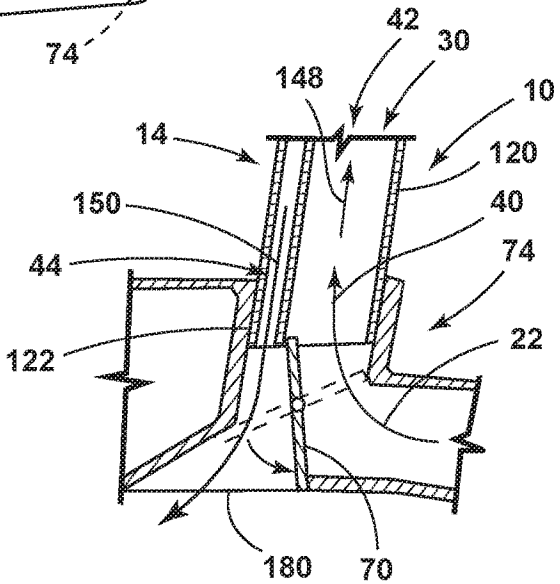
FIG. 20B is a schematic cross-sectional view of the accessory port of FIG. 20A with the baffle moved into the accessory state.
Figure 20A:
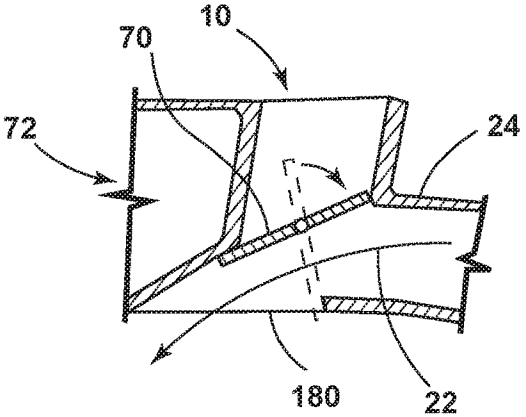
FIG. 20A is a schematic cross-sectional view of an aspect of an accessory port showing the baffle in the standard state.

Referring now to FIGS. 17-19, in a venting dryer 50, the accessory port 10 can include an operable baffle 70 for operating the airflow path 24 of the venting dryer 50 between the standard state 72 and the accessory state 74. As exemplified in FIG. 19, the baffle 70 is shown in the accessory state 74, such that process air 22 from the blower 16 is moved out of the accessory port 10 and into and through the accessory tool 14. Where the baffle 70 is moved to the standard state 72, shown in FIG. 19 in dashed line, the baffle 70 allows the blower 16 to direct process air 22 through the accessory port 10 and toward the rotating drum 18 for the appliance 12. As shown in FIGS. 17-19, the baffle 70 is positioned in close proximity to the blower 16, such that a maximum amount of process air 22 can be utilized within the airflow path 24 and the accessory airflow path 30 through operation of the baffle 70 within the accessory port 10.

Referring again to FIGS. 1-23, the laundry appliance 12 can include the blower 16 for delivering process air 22 through the airflow path 24. The airflow path 24 extends through the rotating drum 18 or other processing chamber for processing and dehumidifying damp articles contained therein. The airflow path 24 also includes the accessory port 10 that can be coupled with any one of the accessory tools 14 described herein. When the interface 76 for the accessory tool 14 is coupled with the accessory port 10, process air 22 is moved by the blower 16 and through the accessory port 10 to be utilized by the accessory tool 14 for accomplishing various air-related functions within and around the cabinet 46 of the appliance 12 and at various positions external to the cabinet 46 of the appliance 12. This accessory process air 40 can be used by the accessory tool 14 for accomplishing suction-related tasks and blower-related tasks, depending upon the type of appliance 12 and the type of accessory tool 14 coupled with the accessory port 10.

As discussed above, the laundry appliance 12 can be in the form of a venting dryer 50, where the blower 16 moves process air 22 through the airflow path 24 and out an exhaust port 170 of the laundry appliance 12. In this condition, the accessory port 10 is typically positioned downstream of the blower 16 to provide accessory blowing air 148 through the accessory tool 14. The accessory port 10 can include the baffle 70 for redirecting the process air 22 between the exhaust port 170 in the standard state 72 and the accessory tool 14 in the accessory state 74. When the interface 76 for the accessory tool 14 is inserted into the accessory port 10, the interface 76 operates the baffle 70 to the accessory state 74 to redirect the process air 22 through the accessory tool 14 to define the accessory process air 40.

The laundry appliance 12 can also be in the form of a recirculating dryer 54. In this condition, as exemplified in FIGS. 15-16 and 20-20B, the accessory port 10 receives the interface 76 for the accessory tool 14 and operates the baffle 70, via the baffle actuator 80, for redirecting the process air 22. Again, the baffle 70 can define the standard state 72, where the process air 22 moves through the typical airflow path 24. When the baffle 70 is engaged by the accessory tool 14, the baffle 70 within the accessory port 10 creates a positive airflow path 120 for providing positive airflow 42 in the form of blowing air 148 into the accessory tool 14 and also creates a negative airflow path 122 that generates the negative airflow 44 in the form of suction air 150 for bringing fresh air 90 into the airflow path 24 for the laundry appliance 12 via the accessory tool 14. The positive airflow path 120 and the negative airflow path 122 can be used in the accessory tools 14 for providing blowing air 148 as well as suction air 150 or vacuum pressure for accomplishing various air-related tasks within and around the laundry appliance 12.

Where the accessory port 10 is coupled with a recirculating dryer 54, the accessory port 10 can include a dedicated lint filter 180 for removing particulate material from the fresh air 90 being suctioned into the airflow path 24. Such a dedicated lint filter 180 is typically positioned within the accessory tool 14 itself or within the accessory port 10. In such an embodiment, the accessory port 10 can be removable for cleaning of the dedicated lint filter 180.

According to various aspects of the device, the accessory tools 14 can include various sensors 190 for sensing a drying condition within the accessory tool 14, the airflow path 24 and/or within the process air 22. These sensors 190 can include one or more of humidity sensors, conductivity sensors for sensing a dryness level, temperature sensors and airflow sensors. Other sensors 190 may also be utilized within the airflow path 24 for monitoring various information concerning the process air 22 and the accessory process air 40. For utilizing the sensors 190, the accessory port 10 can include an airflow interface 76 for directing process air 22 through the accessory tool 14. The accessory port 10 can also include an electrical/data interface 194 for placing the various sensors 190 for the accessory tools 14 in communication with the data and electrical systems for the drying appliance 12. Through this electrical/data interface 194, the sensors 190 are able to communicate with the drying appliance 12 and the various temperature control mechanisms 78 and other controllers to control operation of a blower 16, the heating and cooling systems, various timers, steam generating devices and other similar systems that are located within the laundry appliance 12. These systems can be used to modify the conditions of the process air 22 and the accessory process air 40.

As exemplified in FIGS. 12-23, the laundry appliance 12 can include the baffle 70 that redirects the flow of process air 22 between the standard state 72 and the accessory state 74. As discussed above, the accessory state 74 is defined by the movement of the accessory process air 40 through the accessory port 10 and into the accessory tool 14. This baffle 70 can be manipulated between the fully open standard state 72 for typical use of the laundry appliance 12. In addition, a fully closed position of the baffle 70, indicative of the accessory state 74, can be utilized where the accessory tool 14 is connected with the airflow path 24 via the accessory port 10. It is contemplated that various intermediary positions of the baffle 70 between the standard and accessory states 72, 74 can be utilized for allowing process air 22 to pass through the airflow path 24 and the accessory airflow path 30, contemporaneously. In such a condition, at least a limited number of drying options can be utilized by the laundry appliance 12 for drying various damp articles within the rotating drum 18. Typically, such drying functions will include low heat functions or no heat functions such that heat does not build up within the airflow path 24 as a consequence of the airflow being separated between the primary airflow path 24 within the appliance 12 and the accessory airflow path 30 within the accessory tool 14 and external to the appliance 12.

Figure 22:
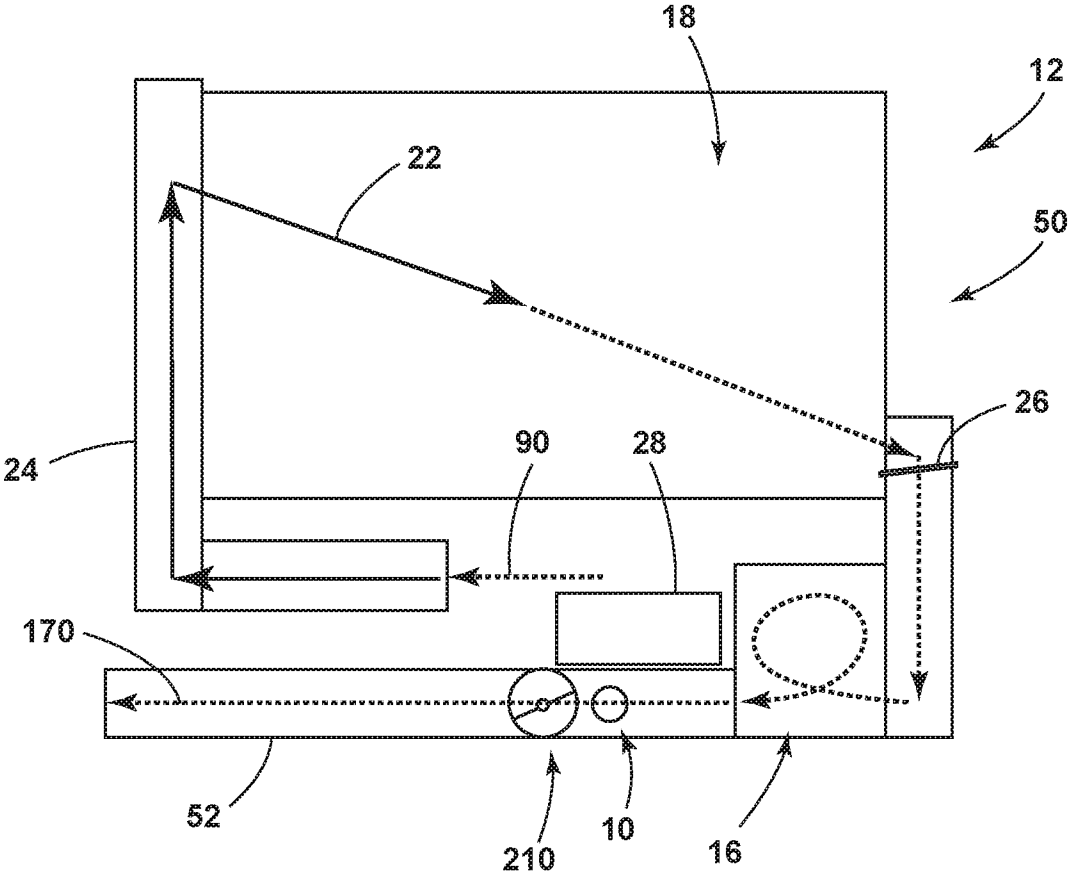
FIG. 22 is a schematic cross-sectional view of an exhaust-type drying appliance that incorporates a diverter valve, shown in the standard state.
Figure 23:
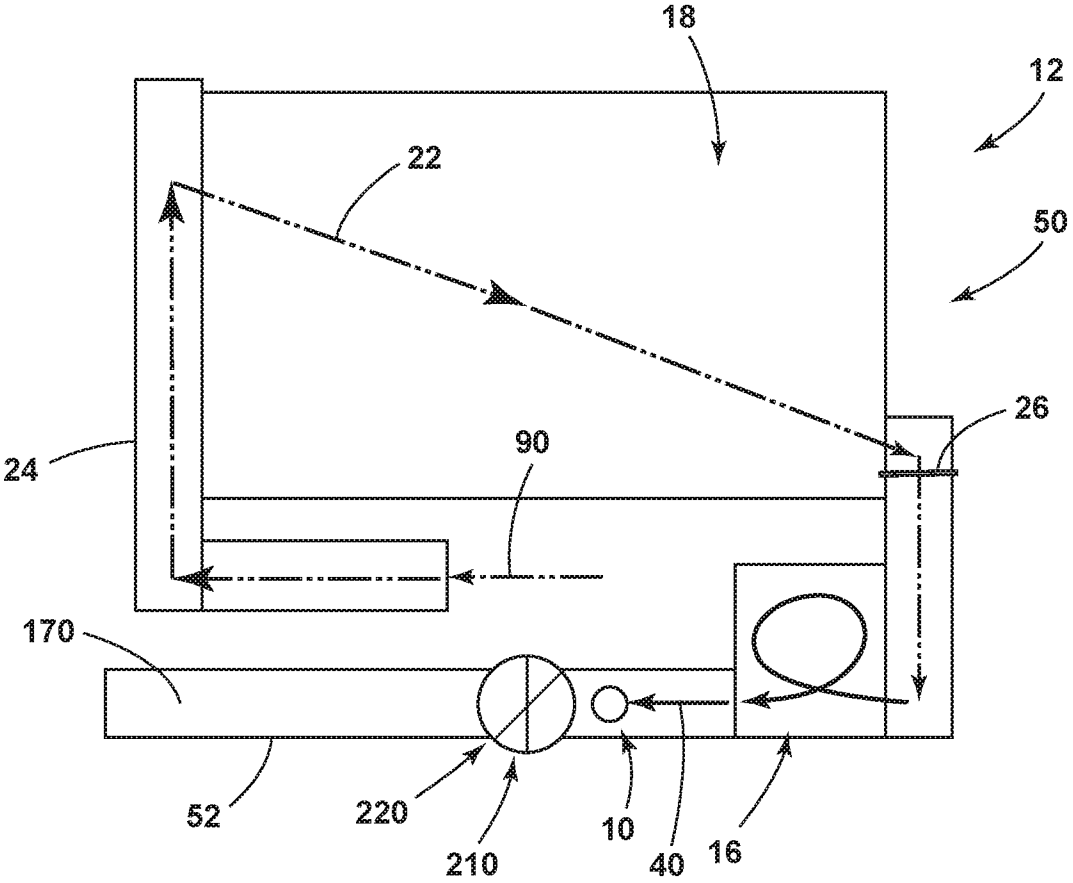
FIG. 23 is a schematic cross-sectional view of a laundry appliance of FIG. 22 that incorporates a diverter valve for operating various accessory tools in combination with the laundry appliance and shown in the secured position.

According to various aspects of the device, as exemplified in FIGS. 22 and 23, various diverter valves 210 can be utilized to redirect the process air 22 from the standard state 72 and to the accessory state 74. These diverter valves 210 can be mechanical, electrical, electromechanical, and other similar diverter mechanisms that can be utilized for modifying the flow of the process air 22 through the appliance 12 and through the accessory port 10 and the accessory tools 14.

According to various aspects of the device, a closed position of the diverter valve 210 can define a secured position 220. This secured position 220 can be used to define the accessory state 74 or to close off the airflow path 24 and prevent infiltration of the exterior air into the airflow path 24. By limiting infiltration of the exterior air into the airflow path 24, the airflow path 24 can be utilized for fire retardant purposes. Stated another way, where an ignition event occurs with respect to the laundry appliance 12, the airflow path 24 can be closed off such that air is impeded from traveling through the airflow path 24 and toward the ignition event. This secured position 220 can also be used to prevent infiltration of the exterior air during extreme weather conditions such as extreme cold, extreme heat, extreme humidity or other temperature and precipitation extremes. Accordingly, the diverter valve 210 can be used to partially slow the spread of undesirable moisture and thermal conditions within the appliance 12.

Referring again to FIGS. 1-23, the various accessory tools 14 that can be utilized with the accessory port 10 can include, but are not limited to, a shoe-drying attachment 100, a de-fuzzing attachment 230, an external fabric-drying structure (such as an assisted hang-dry attachment 232 and a rack attachment 130, the hanger attachment 136), a blower/vacuum attachment 234, a universal hose 236, and other similar tools that can provide air-related functionality within and around the laundry appliance 12 via interface 76 with the accessory port 10.

Figure 26:
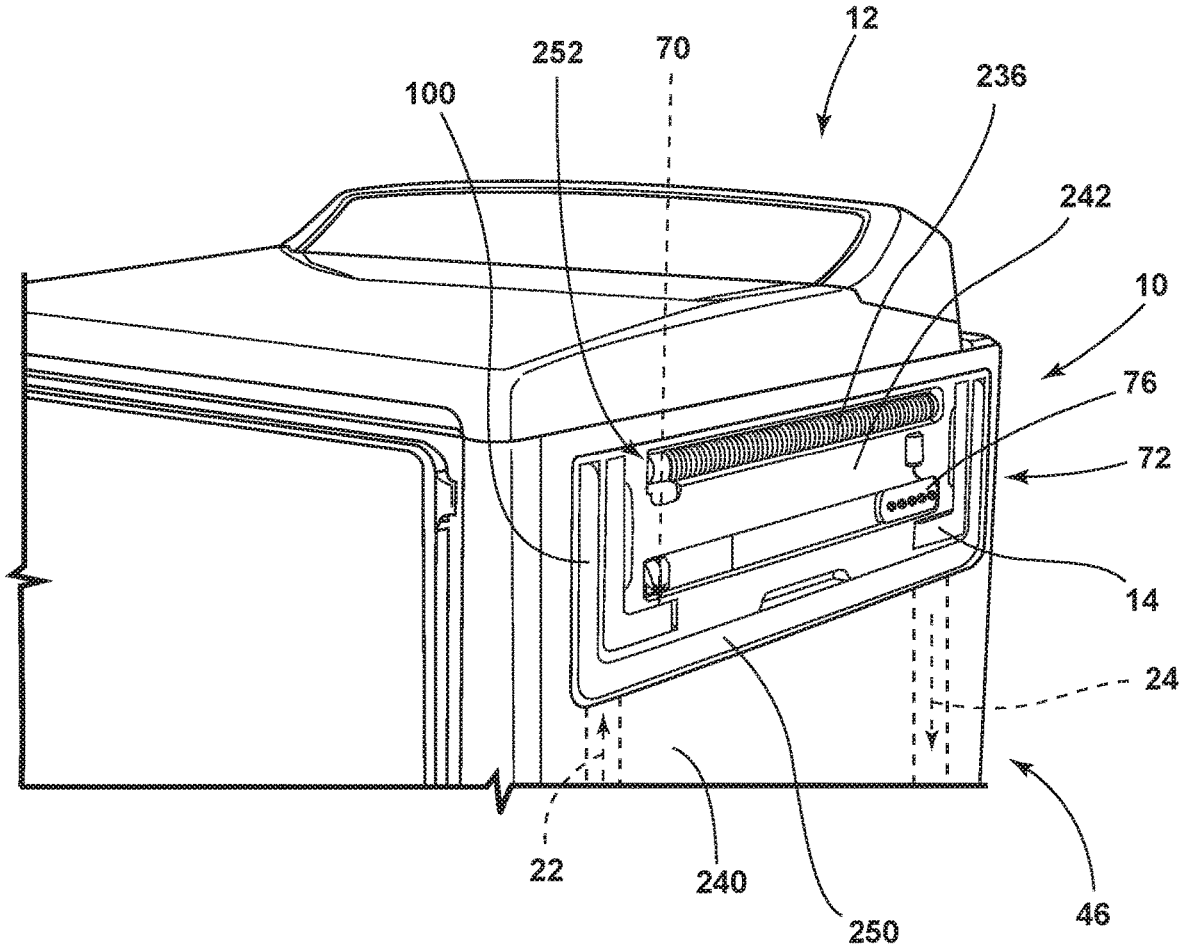
FIG. 26 is a side perspective view of an appliance incorporating an aspect of the accessory port that is plumbed within the cabinet wall and includes integral fold-out tools that are illustrated in the stowed standard state.
Figure 27:
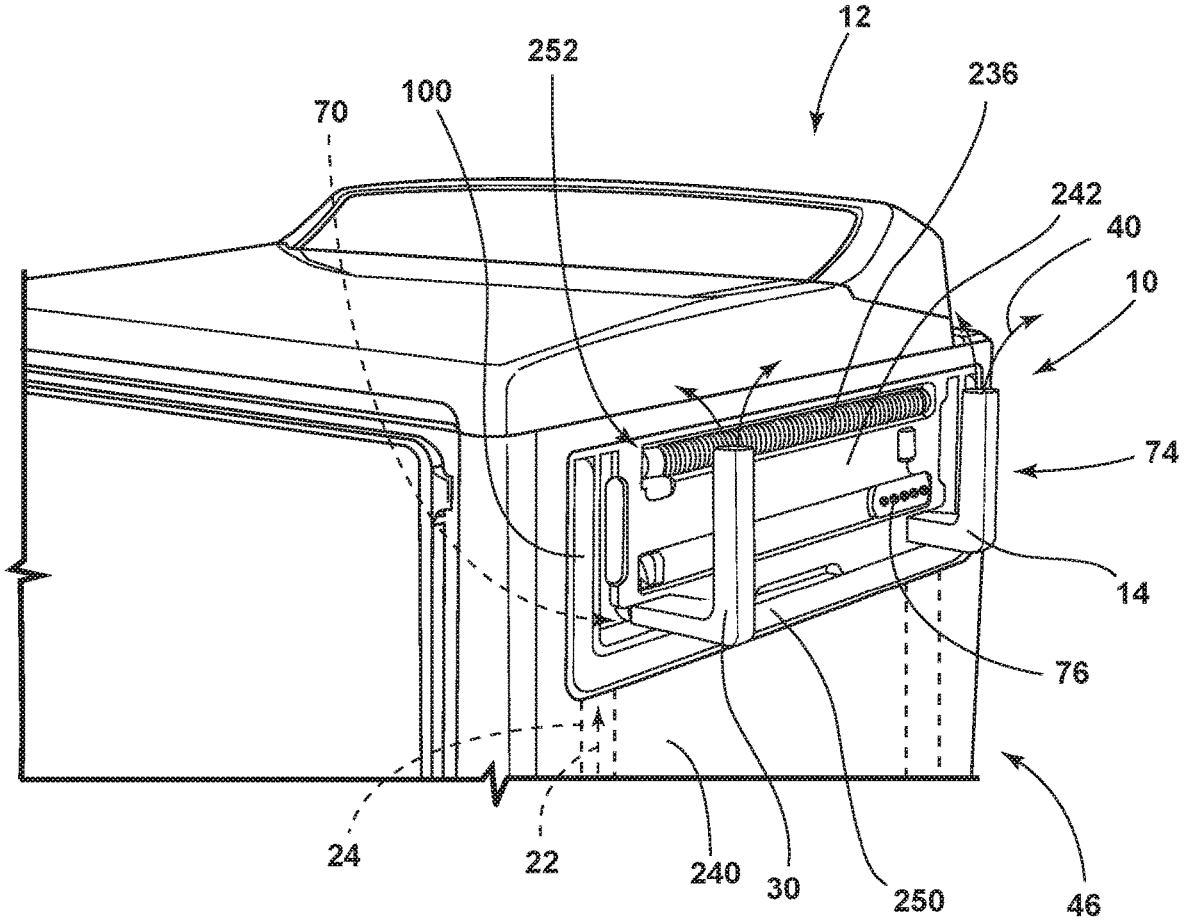
FIG. 27 is a side perspective view of the appliance of FIG. 26 illustrating a fold-out tool rotated laterally to be in the accessory state.
Figure 28:
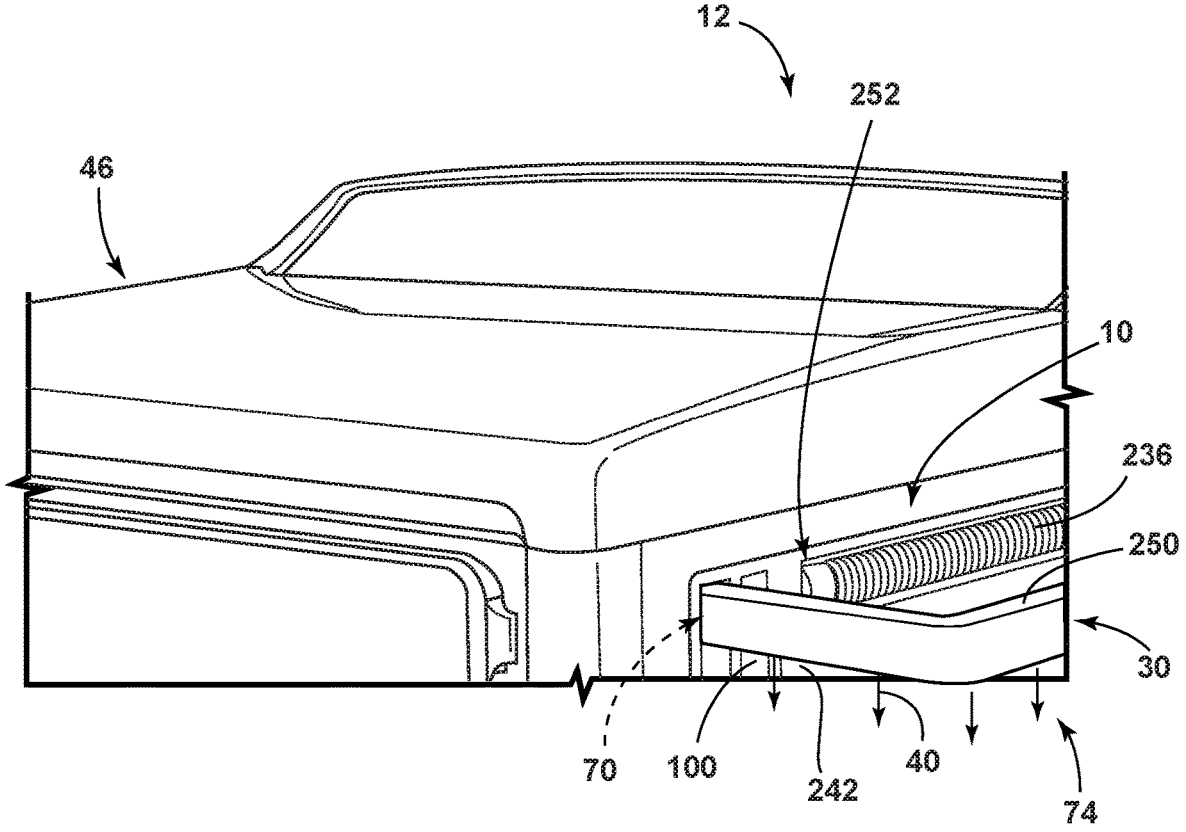
FIG. 28 is a side perspective view of the appliance of FIG. 26 illustrating another fold-out tool rotated vertically to be in the accessory state.

Referring now to FIGS. 26-28, the accessory port 10 can be positioned within any one of various walls or panels of the outer structural cabinet 46 for the appliance 12. In at least one aspect, the accessory port 10 can be incorporated within sidewall 240 of the appliance 12. In such an embodiment, the accessory port 10 can be plumbed, or recessed, within the sidewall 240. In addition, the various accessory tools 14 can be incorporated within a housing 242 of the accessory port 10. In this configuration, the various accessory tools 14 are operable between the standard state 72, where the accessory tools 14 are folded flush within the housing 242, to the accessory state 74, where the accessory tools 14 are folded out to project from the housing 242 and the sidewall 240 of the appliance 12. In the standard state 72, the process air 22 is delivered through the typical airflow path 24 during a conventional operation of the appliance 12 (shown generally in FIG. 15). When any one or more of the accessory tools 14 are operated into the accessory state 74, certain air valves, such as baffles 70, within the accessory port 10 are operated to deliver the process air 22 through ducts or conduits disposed within the sidewall 240 of the appliance 12. As a result, the process air 22 is delivered to define accessory process air 40 that is delivered through the accessory airflow path 30 of the accessory tools 14.

Referring again to FIG. 26-28, operation of the integral accessory tools 14 between the standard and accessory states 72, 74, operates an interior baffle 70. Accordingly, as the accessory tools 14 are rotated, this baffle 70 or other air valve is also operated to open the accessory airflow path 30 to deliver the accessory process air 40 therethrough. This rotation of the accessory tools 14 can be in any one of various directions, such as lateral, vertical, angular, rotary, combinations thereof or other similar rotation. The plumbed housing 242 having the accessory port 10 may also include a plug-in accessory interface 76 similar to that illustrated and discussed previously. Using this configuration, each of the accessory tools 14 that are integral with the accessory port 10 may have a dedicated baffle 70 that is operated between a dedicated standard and accessory states 72, 74 as the respective accessory tool 14 is operated with respect to the remainder of the accessory port 10.

As exemplified in FIGS. 26-28, the integral accessory tools 14 can include, but are not limited to, a drying bar 250, shoe drying attachment 100, a drying wand 252 with an extendable hose 236, and other accessory tools 14 similar to those described herein. These various accessory tools 14 can include both blowing and suction-type functions depending on the configuration of the appliance 12 and the configuration of the various integral accessory tools 14 of the accessory port 10.

In various aspects of the device, as exemplified in FIGS. 13-16 and 26-28, the baffle 70 and the integral accessory tools 14 can cooperate with a recirculating airflow path 24 to produce both a suction portion at air inlet ports 106 and a blowing portion at air outlet ports 102. In such an aspect of the device, the baffles 70 for the integral accessory tools 14 can align air flow paths with the inlet and outlet ports 106, 102 to account for suction and blowing functions.

According to another aspect of the present disclosure, a laundry appliance includes a processing chamber positioned within a cabinet. A blower delivers process air through an airflow path and through the processing chamber. An accessory port is positioned on an exterior surface of the cabinet and coupled with the airflow path. The accessory port selectively redirects the process air through an accessory airflow path to define accessory process air. An accessory tool that selectively engages the accessory port to define the accessory airflow path.

According to another aspect, the accessory port includes an internal baffle that is operable between a standard state that directs the process air to the processing chamber and an accessory state that redirects the process air to the accessory airflow path to define the accessory process air.

According to yet another aspect, the internal baffle is operable using the accessory tool.

According to another aspect of the present disclosure, installation of the accessory tool into the accessory port biases the internal baffle from the standard state to the accessory state. The internal baffle includes a biasing mechanism that biases the internal baffle toward the standard state.

According to another aspect, the accessory airflow path includes a turbine that is rotationally operated by the accessory process air to define a secondary airflow that is directed along a rotational axis of the turbine.

According to yet another aspect, the turbine is positioned within the cabinet and proximate the accessory port.

According to another aspect of the present disclosure, the turbine is positioned within the accessory tool.

According to another aspect, the accessory tool includes an external fabric-drying structure.

According to yet another aspect, the blower and the airflow path define the process air as a recirculating flow of air through the processing chamber.

According to another aspect of the present disclosure, the blower and the airflow path direct the process air to an exhaust port.

According to another aspect, the accessory port includes a dedicated lint filter.

According to yet another aspect, a laundry appliance includes a processing chamber positioned within a cabinet. A blower delivers process air through a recirculating airflow path that includes the processing chamber. An accessory port is positioned on an exterior surface of the cabinet and coupled with the recirculating airflow path. The accessory port selectively redirects the process air through an accessory airflow path to define accessory process air. An accessory tool selectively engages the accessory port to define the accessory airflow path.

According to another aspect of the present disclosure, the accessory tool includes an air inlet port and an air outlet port.

According to another aspect, the air inlet port draws external air into the accessory airflow path for delivery to the recirculating airflow path. The air outlet port is configured to deliver the accessory process air to an external environment.

According to yet another aspect, at least one of the air inlet port and the air outlet port are configured to perform an air-related function at a position external to the cabinet.

According to another aspect of the present disclosure, the accessory tool includes at least one sensor that is in selective communication with at least the accessory airflow path, and wherein the at least one sensor monitors a drying condition of at least the accessory process air within the accessory tool.

According to another aspect, the at least one sensor is in selective communication with an electrical and data interface of the accessory port when the accessory tool is in an accessory state, and wherein the at least one sensor includes at least one of a temperature sensor, a conductivity sensor and a humidity sensor.

According to yet another aspect, the accessory port includes an internal baffle that is operable between a standard state that directs the process air to the processing chamber and an accessory state that redirects the process air to the accessory airflow path to define the accessory process air.

According to another aspect of the present disclosure, a laundry appliance includes a processing chamber positioned within a cabinet. A blower delivers process air through an airflow path and to an exhaust port. The airflow path includes the processing chamber. An accessory port is positioned on an exterior surface of the cabinet and coupled with the airflow path. The accessory port selectively redirects the process air through an accessory airflow path to define accessory process air. An accessory tool selectively engages the accessory port to define the accessory airflow path.

According to another aspect, the accessory port includes an internal baffle that is operable between a standard state that directs the process air to the processing chamber and an accessory state that redirects the process air to the accessory airflow path to define the accessory process air.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a processing chamber positioned within a cabinet;

a blower that delivers process air through an airflow path and through the processing chamber;

an accessory port positioned on an exterior surface of the cabinet and coupled with the airflow path, wherein the accessory port selectively redirects the process air through an accessory airflow path to define accessory process air; and an accessory tool having an interface at one end that selectively engages the accessory port to define the accessory airflow path that is in communication with the airflow path, and wherein the interface further includes an air inlet port and an air outlet port, the air inlet port drawing external air into the air flow path, the air outlet port directing the accessory process air from the airflow path, through the accessory airflow path, and to a function site disposed at an opposing end of the accessory tool.

2. The laundry appliance of claim 1, wherein the accessory port includes an internal baffle that is operable between a standard state that directs the process air to the processing chamber and an accessory state that redirects the process air to the accessory airflow path to define the accessory process air.

3. The laundry appliance of claim 2, wherein the internal baffle is operable using the interface of the accessory tool.

4. The laundry appliance of claim 2, wherein installation of the interface of the accessory tool into the accessory port biases the internal baffle from the standard state to the accessory state, and wherein the internal baffle includes a baffle biasing mechanism that biases the internal baffle toward the standard state.

5. The laundry appliance of claim 1, wherein the function site of the accessory tool includes an external fabric-drying structure that is in communication with the air outlet port.

6. The laundry appliance of claim 1, wherein the blower and the airflow path define the process air as a recirculating flow of air through the processing chamber.

7. The laundry appliance of claim 1, wherein the accessory port includes a dedicated lint filter.

8. A laundry appliance comprising:

a processing chamber positioned within a cabinet;

a blower that delivers process air through a recirculating airflow path that includes the processing chamber;

an accessory port positioned on an exterior surface of the cabinet and coupled with the recirculating airflow path, wherein the accessory port selectively redirects the process air through an accessory airflow path to define accessory process air; and an accessory tool includes an interface end that selectively engages the accessory port to define the accessory airflow path, the accessory tool including an opposing end having a function site, wherein the interface end of the accessory tool includes an air inlet port and an air outlet port, wherein the air inlet port directs external air into the recirculating airflow path, and wherein the air outlet port directs accessory process air from the recirculating airflow path and to the accessory airflow path, wherein one of the air inlet port and the air outlet port are in communication with the function site via the accessory airflow path.

9. The laundry appliance of claim 8, wherein the air inlet port draws external air into the recirculating airflow path for delivery to the accessory airflow path, and wherein the air outlet port is configured to deliver the accessory process air to an external environment.

10. The laundry appliance of claim 9, wherein at least one of the air inlet port and the air outlet port are configured to perform an air-related function, via the function site, at a position external to the cabinet.

11. The laundry appliance of claim 8, wherein the accessory tool includes at least one sensor that is in selective communication with at least the accessory airflow path, and wherein the at least one sensor monitors a drying condition of at least the accessory process air within the accessory tool.

12. The laundry appliance of claim 11, wherein the at least one sensor is in selective communication with an electrical and data interface of the accessory port when the accessory tool is in an accessory state, and wherein the at least one sensor includes at least one of a temperature sensor, a conductivity sensor and a humidity sensor.

13. The laundry appliance of claim 8, wherein the accessory port includes an internal baffle that is operable between a standard state that directs the process air to the processing chamber and an accessory state that redirects the process air to the accessory airflow path to define the accessory process air.

14. A laundry appliance comprising:

a processing chamber positioned within a cabinet;

a blower that delivers process air through a recirculating airflow path that includes the processing chamber;

an accessory port positioned on an exterior surface of the cabinet and coupled with the recirculating airflow path, wherein the accessory port selectively redirects the process air through an accessory airflow path to define accessory process air; and an accessory tool that includes an interface end that selectively engages the accessory port and an opposing end that includes a function site, the interface end of the accessory tool further including an air inlet port and an air outlet port, wherein engagement of the interface end with the accessory port selectively places the air inlet port and the air outlet port in communication with the blower for drawing suction air through the air inlet port and into the recirculating airflow path, and directing the accessory process air from the recirculating airflow path and through the air outlet port, one of the air inlet port and the air outlet port being in communication with the function site via the accessory airflow path.

15. The laundry appliance of claim 14, wherein at least one of the air inlet port and the air outlet port are configured to perform an air-related function, via the function site, at a position external to the cabinet.

16. The laundry appliance of claim 15, wherein the air-related function of the function site and the air inlet port is a suction-related tool.

17. The laundry appliance of claim 15, wherein the air-related function of the function site and the air outlet port is a blowing-related tool.

18. The laundry appliance of claim 14, wherein the accessory tool includes at least one sensor that is in selective communication with at least the accessory airflow path, and wherein the at least one sensor monitors a drying condition of at least the accessory process air within the accessory tool.

19. The laundry appliance of claim 18, wherein the at least one sensor is in selective communication with an electrical and data interface of the accessory port when the accessory tool is in an accessory state, and wherein the at least one sensor includes at least one of a temperature sensor, a conductivity sensor and a humidity sensor.

20. The laundry appliance of claim 14, wherein the accessory port includes an internal baffle that is operable between a standard state that directs the process air to the processing chamber and an accessory state that redirects the process air to the accessory airflow path to define the accessory process air.

* * * * *